US010245612B2

(12) United States Patent
Pringle-Iv et al.

(10) Patent No.: US 10,245,612 B2
(45) Date of Patent: Apr. 2, 2019

(54) SEALANT-APPLICATOR TIPS

(71) Applicant: The Boeing Company, Chicago, IL (US)

(72) Inventors: John W. Pringle-Iv, Gardena, CA (US); Don D. Trend, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 41 days.

(21) Appl. No.: 15/373,621

(22) Filed: Dec. 9, 2016

(65) Prior Publication Data

US 2018/0161802 A1 Jun. 14, 2018

(51) Int. Cl.

| | |
|---|---|
| ***B05C 9/02*** | (2006.01) |
| ***B05D 5/00*** | (2006.01) |
| ***B05C 17/005*** | (2006.01) |
| ***E04F 21/165*** | (2006.01) |

(52) U.S. Cl.

CPC ..... *B05C 9/02* (2013.01); *B05C 17/005* (2013.01); *B05C 17/00516* (2013.01); *B05D 5/00* (2013.01); *E04F 21/1655* (2013.01)

(58) Field of Classification Search

CPC ..... B05C 17/00503; B05C 17/00506; B05C 17/00516; E04F 21/1655

See application file for complete search history.

(56) References Cited

U.S. PATENT DOCUMENTS 3,627,435 A * 12/1971 Hendershot ..... B05C 17/00516 401/265
4,135,476 A 1/1979 Duryea
4,570,834 A * 2/1986 Ward ..... B05C 17/00516 222/566
5,632,412 A * 5/1997 Harris ..... B05C 17/00503 222/1
6,502,608 B1 * 1/2003 Burchett ..... B05C 17/00516 141/383

(Continued)

FOREIGN PATENT DOCUMENTS

FR 1 342 750 11/1963
GB 2431125 4/2007

(Continued)

OTHER PUBLICATIONS

European Patent Office, Extended European Search Report, EP 17 20 6256 (dated Apr. 17, 2018).

(Continued)

*Primary Examiner* — David P Angwin
*Assistant Examiner* — Bradley S Oliver
(74) *Attorney, Agent, or Firm* — Walters & Wasylyna LLC

(57) ABSTRACT

A sealant-applicator tip comprises a body, having a plane of symmetry and comprising an inlet opening. The sealant-applicator tip also comprises a head, extending from the body opposite the inlet opening. The head comprising a first planar face, comprising a first linear edge, a second planar face, comprising a second linear edge, a third face, comprising a third edge, a fourth face, comprising a fourth edge, a fifth edge, a sixth edge, a seventh edge, and an outlet opening, formed in the third face and in communication with the inlet opening of the body. The sealant-applicator tip further comprises a channel, extending from the inlet opening to the outlet opening.

20 Claims, 14 Drawing Sheets

(56) References Cited

U.S. PATENT DOCUMENTS

| | | | | |
|---|---|---|---|---|
| 6,733,472 | B1 | 5/2004 | Epstein et al. | |
| 6,981,618 | B2 * | 1/2006 | Reisinger | B05C 17/00593 222/326 |
| 8,845,223 | B2 * | 9/2014 | Liao | B05C 17/00516 222/566 |
| 2007/0102484 | A1 * | 5/2007 | Baldwin | B05C 17/00516 222/568 |
| 2010/0239705 | A1 * | 9/2010 | Jorstad | B05C 17/00506 425/461 |
| 2010/0278958 | A1 * | 11/2010 | Chamberlain | B05C 17/00516 425/458 |

FOREIGN PATENT DOCUMENTS

| | | |
|---|---|---|
| GB | 2524508 | 9/2015 |
| GB | 2 529 223 | 2/2016 |
| WO | WO 02/078860 | 10/2002 |
| WO | WO 2010/125399 | 11/2010 |

OTHER PUBLICATIONS

European Patent Office, "Extended European Search Report," App. No. 17206256.4 (dated Jul. 20, 2018).

* cited by examiner

SEALANT-APPLICATOR TIPS

TECHNICAL FIELD

The present disclosure relates to apparatuses and methods for applying a sealant material.

BACKGROUND

A sealant material is commonly used to fill gaps and seal interior corners of a joint formed by two abutting surfaces, for example, where moisture or other contaminants would penetrate and cause deterioration. In certain applications, a first bead of the sealant material is applied along the corner joint and a subsequent second bead of the sealant material is applied along the corner joint over the first bead. Conventionally, two different sealant applicators are required to perform these steps. For example, a first sealant applicator, configured for the dimensions of the first bead, is used to form the first bead. The first sealant applicator must then be replaced by a second sealant applicator, configured for the dimensions of the second bead, which is then used to form the second bead. The need to switch between two different sealant applicators increases manufacturing lead time and cost.

SUMMARY

Accordingly, apparatuses and methods, intended to address at least the above-identified concerns, would find utility.

The following is a non-exhaustive list of examples, which may or may not be claimed, of the subject matter according to the invention.

One example of the subject matter according to the invention relates to a sealant-applicator tip. The sealant-applicator tip comprises a body, having a plane of symmetry. The body comprises an inlet opening. The sealant-applicator tip also comprises a head, extending from the body opposite the inlet opening. The head comprises a first planar face, comprising a first linear edge. The head also comprises a second planar face, oriented at a first non-zero angle to the first planar face and comprising a second linear edge. The first linear edge of first planar face and the second linear edge of the second planar face lie in a virtual flat plane. The head further comprises a third face, separating the first planar face from the second planar face. The third face comprises a third edge. The head additionally comprises a fourth face, comprising a fourth edge. The head also comprises a fifth edge, shared by the first planar face and the fourth face. The head further comprises a sixth edge, shared by the second planar face and the fourth face. The head also comprises a seventh edge, shared by the third face and the fourth face. The head additionally comprises an outlet opening, formed in the third face. The outlet opening is in communication with the inlet opening of the body. The sealant-applicator tip also comprises a channel, extending from the inlet opening to the outlet opening.

The sealant-applicator tip may be used to form a first bead of sealant material when the sealant-applicator tip is moved in a first direction along a corner joint. The sealant-applicator tip may also be used to form a second bead of the sealant material when the sealant-applicator tip is moved in a second direction along the corner joint. The second direction is opposite the first direction. The second bead of the sealant material covers the first bead of the sealant material. The first bead of the sealant material and the second bead of the sealant material form a fillet seal between a first planar surface and a second planar surface forming the corner joint. Accordingly, use of the sealant-applicator tip provides for formation of the first bead of the sealant material followed by a subsequent formation of the second bead of the sealant material, covering the first bead of the sealant material, without removing the sealant-applicator tip from the corner joint or changing between different kinds of sealant application tips.

Another example of the subject matter according to the invention relates to a method of applying a sealant material to a corner joint, formed by a first planar surface and a second planar surface. The method comprises positioning a sealant-applicator tip relative to the corner joint, such that a first planar face of the sealant-applicator tip is in flush surface contact with and parallel to one of the first planar surface or the second planar surface and a second planar face of the sealant-applicator tip is in flush contact with and parallel to another one of the first planar surface or the second planar surface. The method also comprises advancing the sealant-applicator tip in a first direction along the corner joint while supplying the sealant material to the corner joint through a channel of the sealant-applicator tip and shaping the sealant material, supplied to the corner joint, with a seventh edge of the sealant-applicator tip to form a first bead of the sealant material.

The sealant material may accordingly be accurately applied to the corner joint to form the first bead resulting from one continuous linear movement of the sealant-applicator tip along the corner joint in the first direction.

BRIEF DESCRIPTION OF THE DRAWINGS

Having thus described one or more examples of the invention in general terms, reference will now be made to the accompanying drawings, which are not necessarily drawn to scale, and wherein like reference characters designate the same or similar parts throughout the several views, and wherein:

FIG. 1 is a block diagram of a sealant-applicator tip, according to one or more examples of the present disclosure;

FIG. 2 is a schematic, perspective view of the sealant-applicator tip of FIG. 1, according to one or more examples of the present disclosure;

FIG. 3 is a schematic, enlarged perspective view of a head of the sealant-applicator tip of FIG. 2, according to one or more examples of the present disclosure;

FIG. 4 is a schematic, top, plan view of the sealant-applicator tip of FIG. 2, according to one or more examples of the present disclosure;

FIG. 5 is a schematic, bottom, plan view of the sealant-applicator tip of FIG. 2, according to one or more examples of the present disclosure;

FIG. 6 is a schematic left, side elevation view of the sealant-applicator tip of FIG. 2, according to one or more examples of the present disclosure;

FIG. 7 is a schematic right, side elevation view of the sealant-applicator tip of FIG. 2, according to one or more examples of the present disclosure;

FIG. 8 is a schematic, front, end view of the sealant-applicator tip of FIG. 2, according to one or more examples of the present disclosure;

FIG. 9 is a schematic, rear, end view of the sealant-applicator tip of FIG. 2, according to one or more examples of the present disclosure;

FIG. 10 is a schematic, longitudinal section view of the sealant-applicator tip of FIG. 2, according to one or more examples of the present disclosure;

FIG. 11 is a schematic, enlarged, left, side elevation view of the head of the sealant-applicator tip of FIG. 2, according to one or more examples of the present disclosure;

Figure 1:
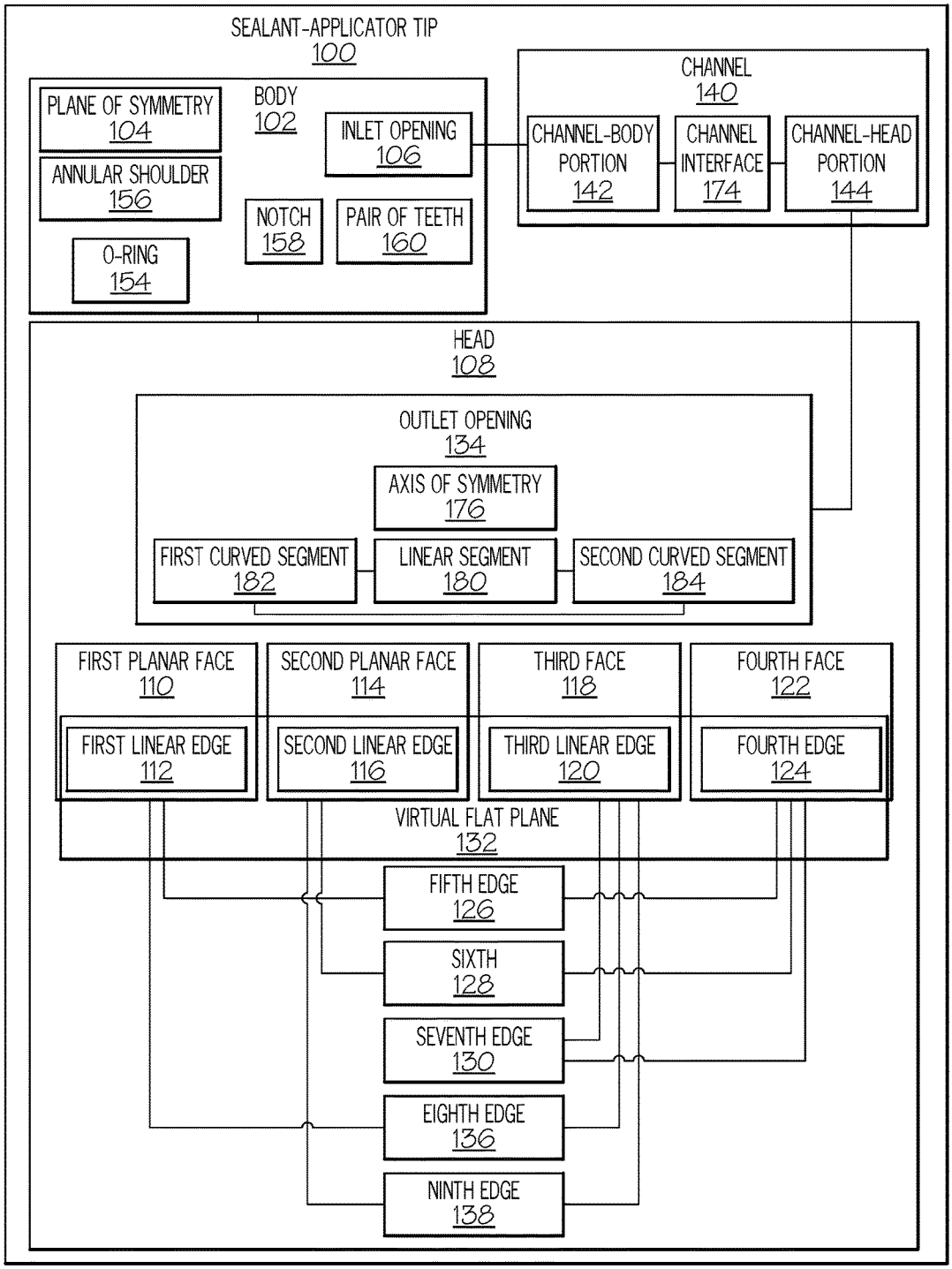
Figure 2:
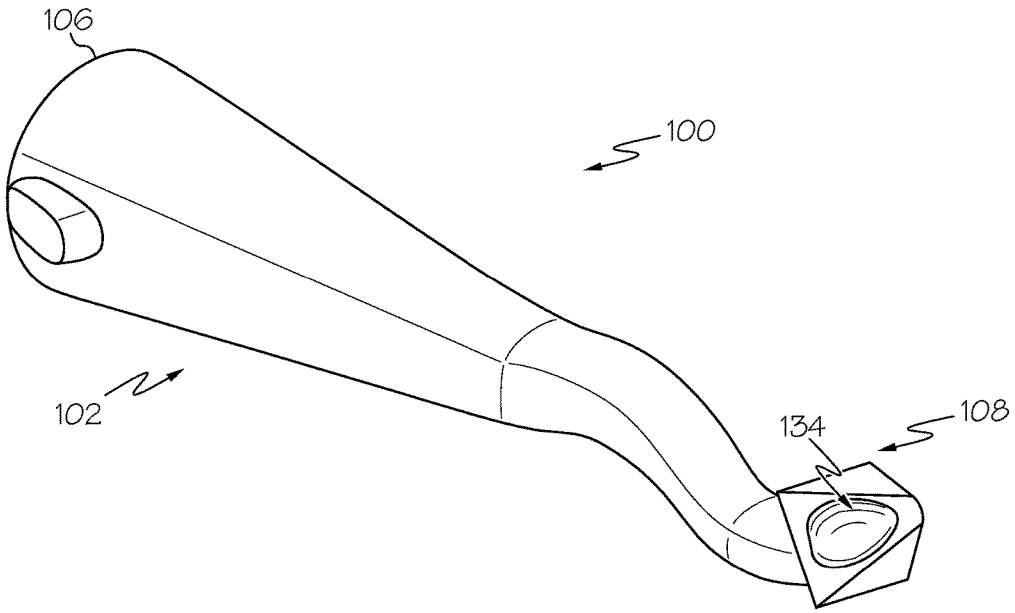
Figure 3:
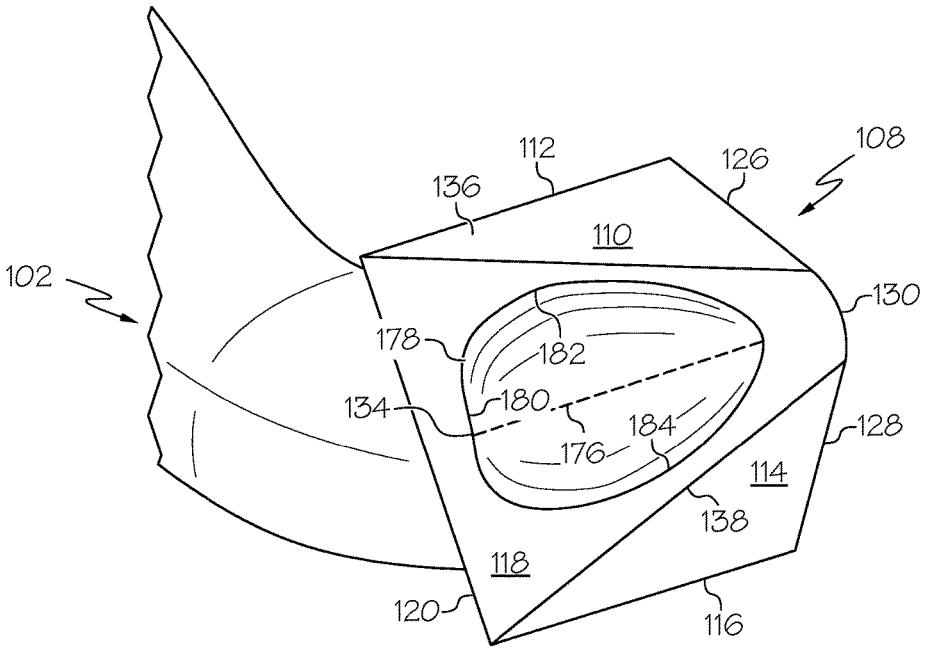
Figure 4:
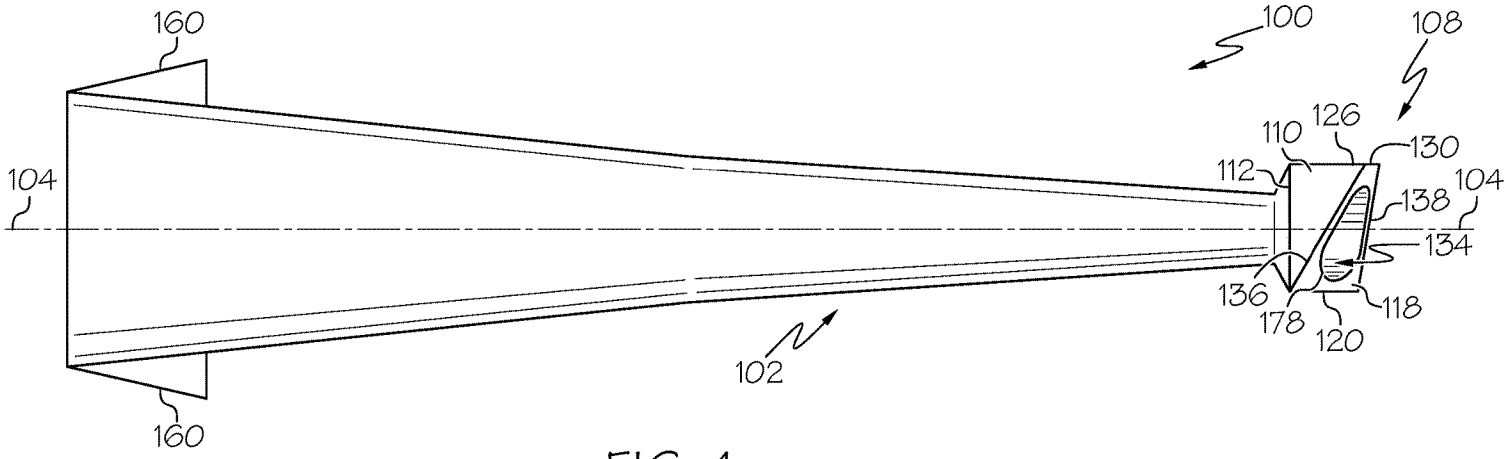
Figure 12:
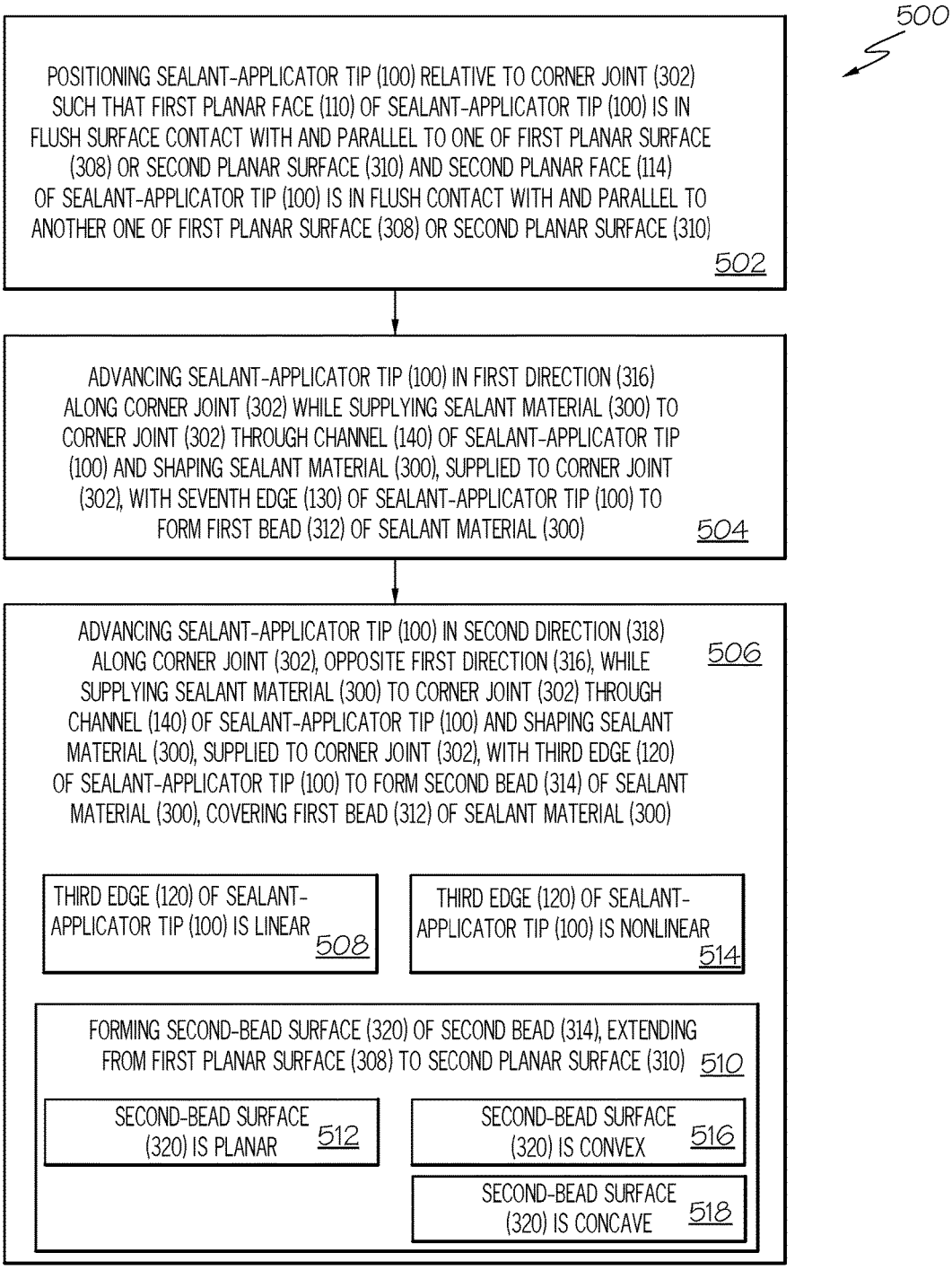
Figure 13:
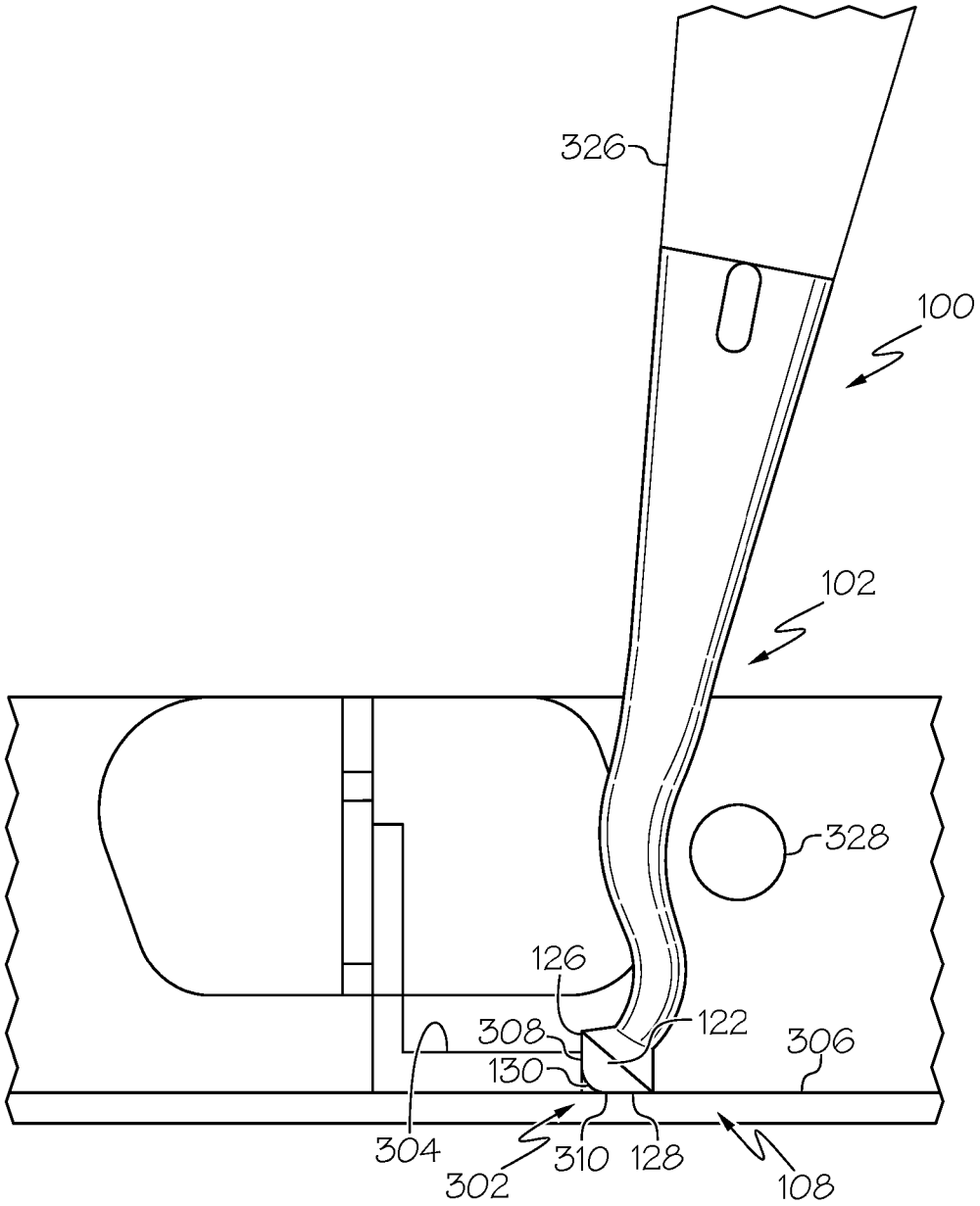
Figure 14:
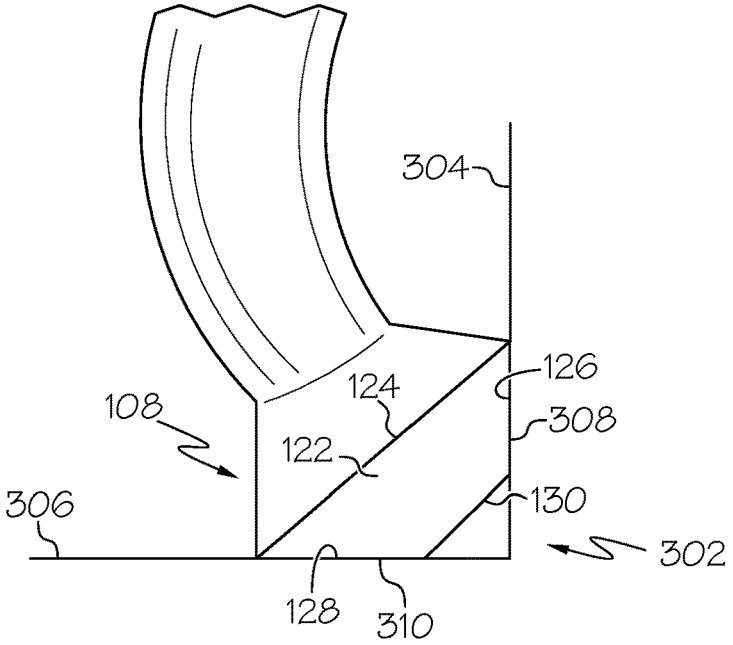
Figure 15:
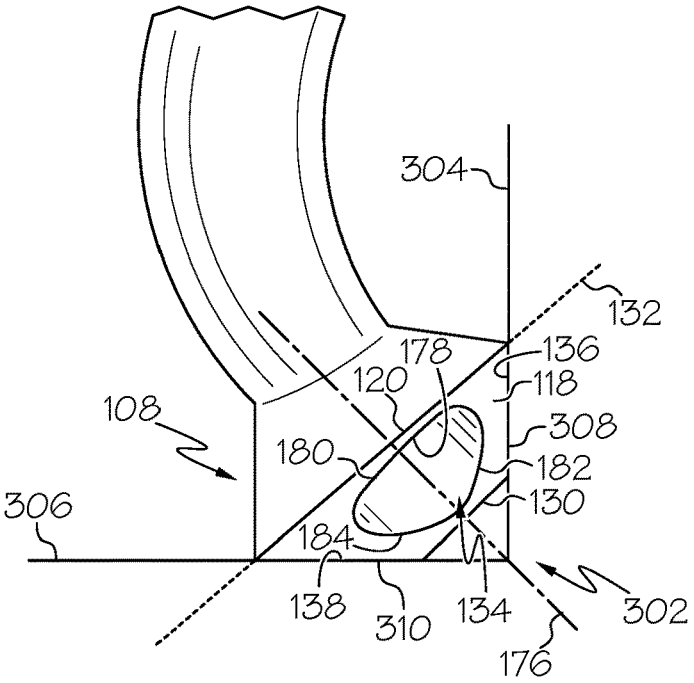
Figure 16A:
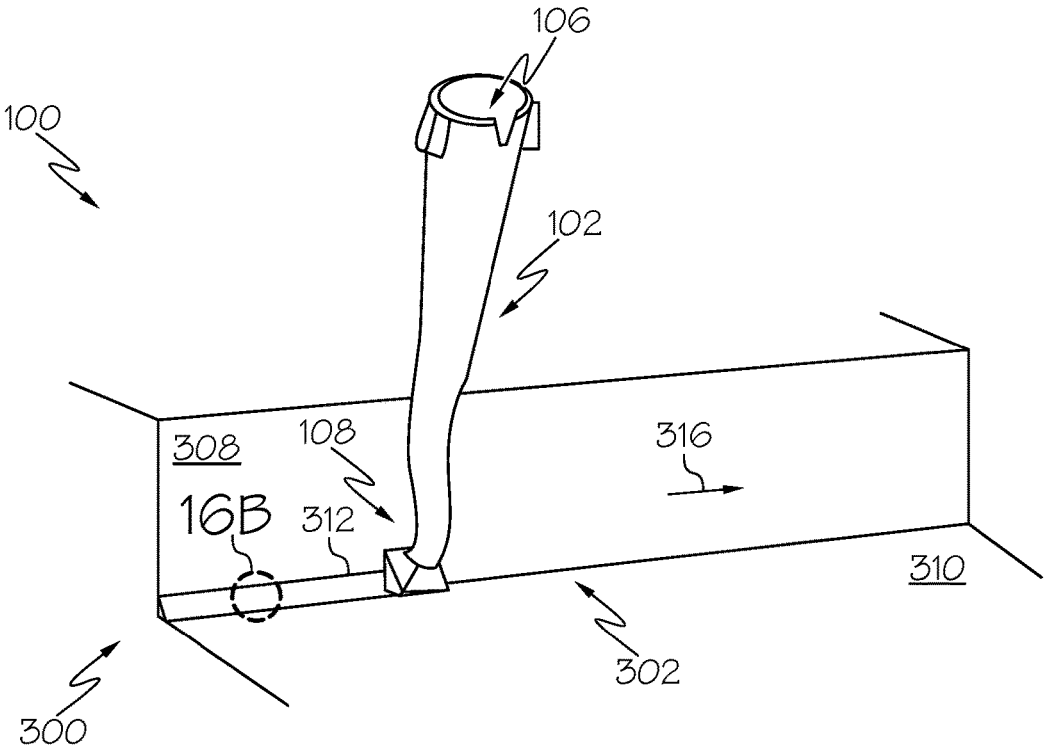
Figure 16B:
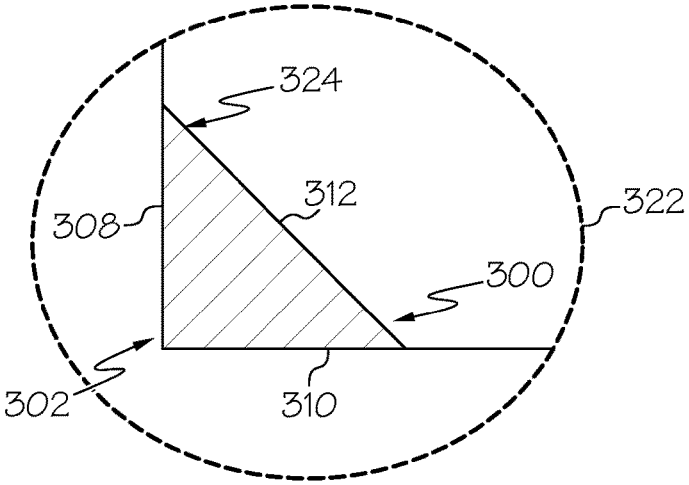
Figure 17A:
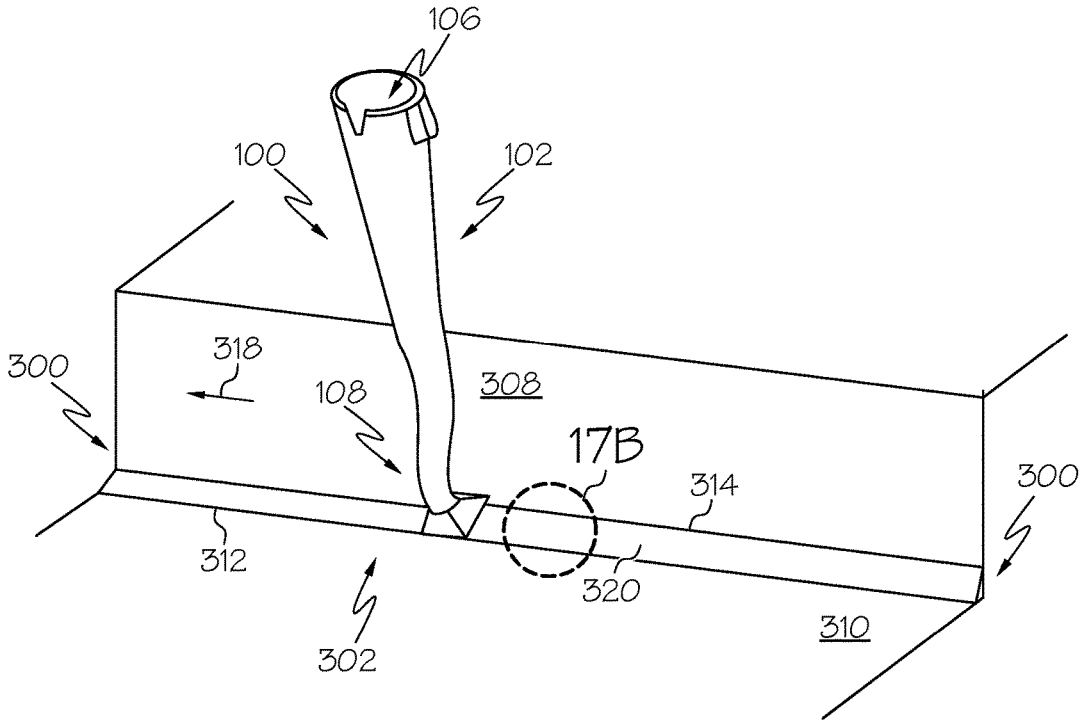
Figure 17B:
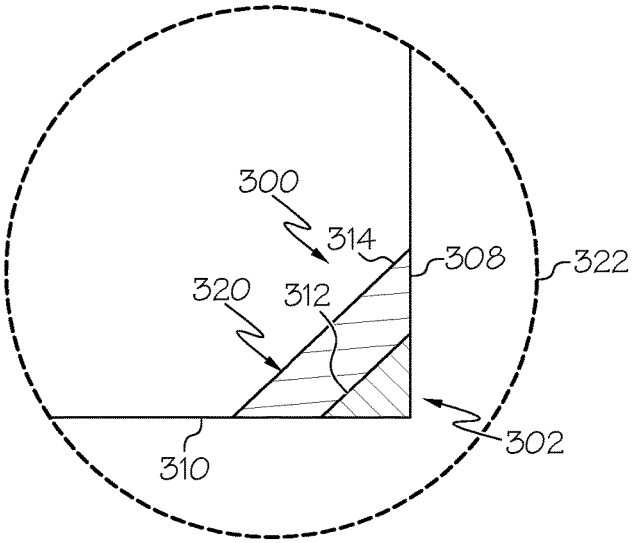
Figure 18:
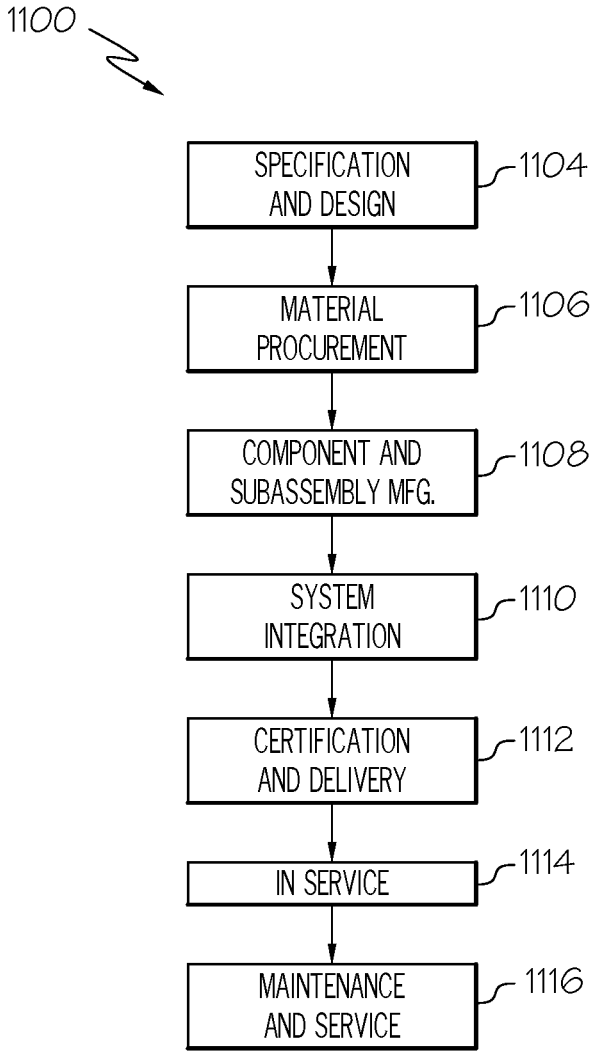
Figure 19:
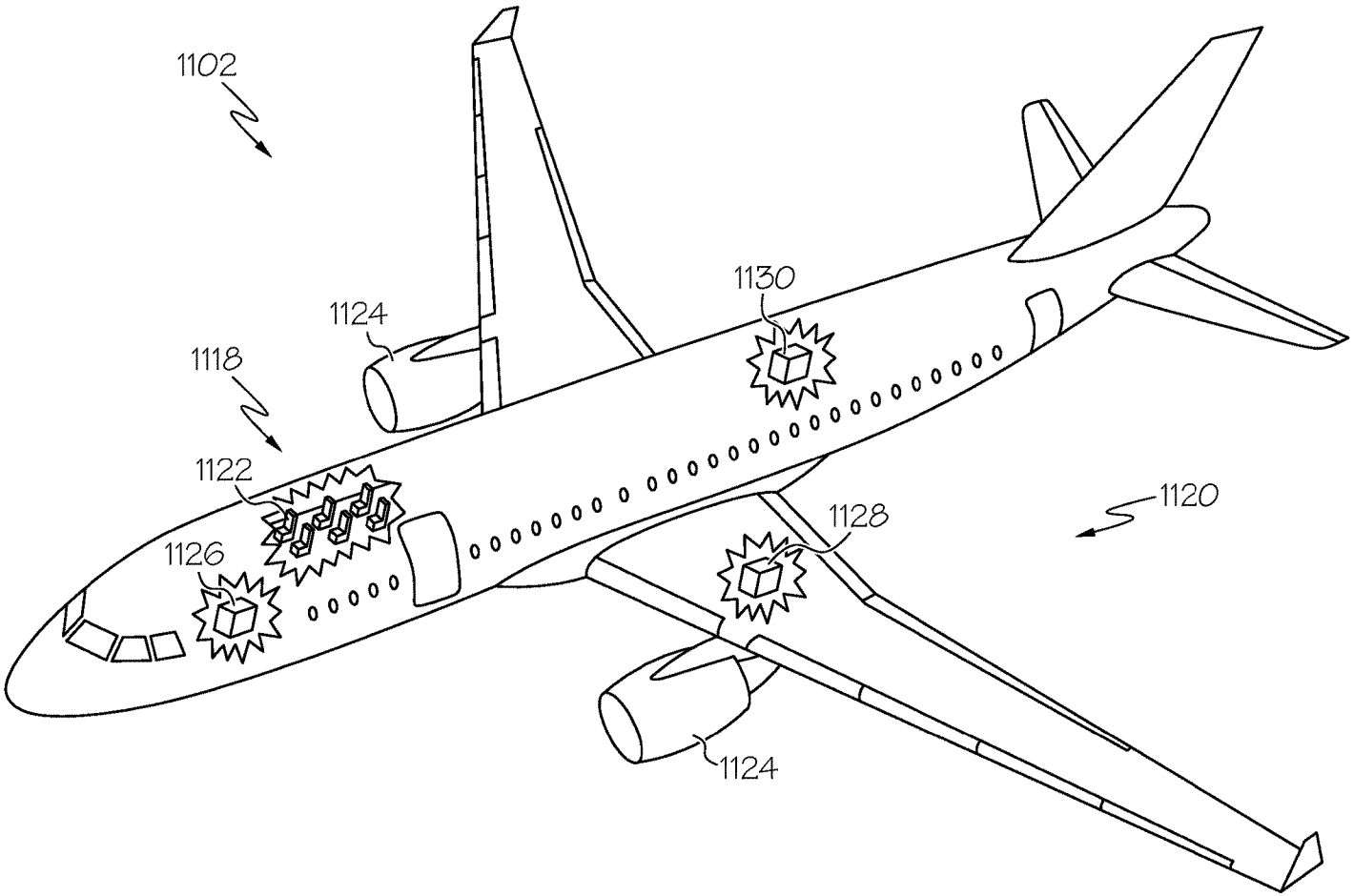

FIG. 12 is a block diagram of a method of utilizing the sealant-applicator tip of FIG. 1 to apply a sealant material, according to one or more examples of the present disclosure;

FIG. 13 is a schematic, environmental, left, side elevation view of the sealant-applicator tip of FIG. 1 positioned relative to a corner joint, according to one or more examples of the present disclosure;

FIG. 14 is a schematic, enlarged, left, side elevation view of the sealant-applicator tip of FIG. 13 positioned relative to the corner joint, according to one or more examples of the present disclosure;

FIG. 15 is a schematic, enlarged, right, side elevation view of the sealant-applicator tip of FIG. 13 positioned relative to the corner joint, according to one or more examples of the present disclosure;

FIG. 16A is a schematic, environmental, perspective view of the sealant-applicator tip of FIG. 13, advancing in a first direction along the corner joint while supplying the sealant material to the corner joint, according to one or more examples of the present disclosure;

FIG. 16B is a schematic, section view of a first bead of the sealant material formed by the sealant-applicator tip of FIG. 16A, according to one or more examples of the present disclosure;

FIG. 17A is a schematic, environmental, perspective view of the sealant-applicator tip of FIG. 13 advancing in a second direction along the corner joint while supplying the sealant material to the corner joint, according to one or more examples of the present disclosure;

FIG. 17B is a schematic, section view of a second bead of the sealant material formed by the sealant-applicator tip of FIG. 17A, according to one or more examples of the present disclosure;

FIG. 18 is a block diagram of aircraft production and service methodology; and FIG. 19 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 12 and 18, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 12 and 18 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification.

For purposes of this disclosure, a system, apparatus, structure, article, element, component, or hardware described as being "configured to" perform a particular function may additionally or alternatively be described as being "adapted to" and/or as being "operative to" perform that function.

Illustrative, non-exhaustive examples, which may or may not be claimed, of the subject matter according the present disclosure are provided below.

Referring generally to FIG. 1 and particularly to, e.g., FIGS. 2-9 and 14-17B, sealant-applicator tip 100 is disclosed. Sealant-applicator tip 100 comprises body 102, having plane of symmetry 104. Body 102 comprises inlet opening 106. Sealant-applicator tip 100 also comprises head 108, extending from body 102 opposite inlet opening 106. Head 108 comprises first planar face 110, comprising first linear edge 112. Head 108 also comprises second planar face 114, oriented at first non-zero angle 162 to first planar face 110 and comprising second linear edge 116. First linear edge 112 of first planar face 110 and second linear edge 116 of second planar face 114 lie in virtual flat plane 132. Head 108 further comprises third face 118, separating first planar face 110 from second planar face 114. Third face 118 comprises third edge 120. Head 108 additionally comprises fourth face 122, comprising fourth edge 124. Head 108 also comprises fifth edge 126, shared by first planar face 110 and fourth face 122. Head 108 further comprises sixth edge 128, shared by second planar face 114 and fourth face 122. Head 108 also comprises seventh edge 130, shared by third face 118 and fourth face 122. Head 108 additionally comprises outlet opening 134, formed in third face 118. Outlet opening 134 is in communication with inlet opening 106 of body 102. Sealant-applicator tip 100 also comprises channel 140, extending from inlet opening 106 to outlet opening 134. The preceding subject matter of this paragraph characterizes example 1 of the present disclosure.

Sealant-applicator tip 100 may be used to form first bead 312 of sealant material 300 when sealant-applicator tip 100 is moved in first direction 316 along corner joint 302 (FIGS. 16A, 16B). Sealant-applicator tip (100) may also be used to form second bead 314 of sealant material 300 when sealant-applicator tip 100 is moved in second direction 318 along corner joint 302 (FIGS. 17A, 17B). Second direction 318 is opposite first direction 316. Second bead 314 of sealant material 300 covers first bead 312 of sealant material 300. First bead 312 of sealant material 300 and second bead 314 of sealant material 300 form fillet seal 322 between first planar surface 308 and second planar surface 310 forming corner joint 302 (FIGS. 16B, 17B). Accordingly, use of sealant-applicator tip 100 provides for formation of first bead 312 of sealant material 300 followed by a subsequent formation of second bead 314 of sealant material 300, covering first bead 312 of sealant material 300, without removing sealant-applicator tip 100 from corner joint 302 or changing between different kinds of sealant application tips.

Sealant-applicator tip 100 is configured to be coupled to sealant-delivery nozzle 326, as illustrated in FIG. 13. As one example, an end of sealant-delivery nozzle 326 is received through inlet opening 106 and partially into channel 140 for delivery of sealant material 300 through outlet opening 134. In one example, sealant-delivery nozzle 326 may be manipulated manually. In another example, sealant-delivery nozzle 326 may be manipulated automatically, such as by an end effector of a robotic arm.

Sealant-applicator tip 100 may be made of any suitable material. As one example, Sealant-applicator tip 100 may be made of a thermoplastic material. As one example, Sealant-applicator tip 100 may be manufactured using an additive manufacturing technology, also known as a three-dimensional printing process, such as fused deposition modeling.

Referring generally to FIG. 1 and particularly to, e.g., FIGS. 3, 6-8, 15, 17A, and 17B, third edge 120 of third face 118 is linear and lies in virtual flat plane 132. Third face 118 is planar. Third face 118 is oblique to first planar face 110 and to second planar face 114. The preceding subject matter of this paragraph characterizes example 2 of the present disclosure, wherein example 2 also includes the subject matter according to example 1, above.

When sealant-applicator tip 100 is moved in second direction 318, opposite first direction 316, along corner joint 302, third edge 120 at least partially shapes sealant material 300, supplied to corner joint 302, to form second-bead surface 320 of second bead 314 (FIGS. 17A, 17B). A linear third edge 120 provides for, or forms, a planar second-bead surface 320 (i.e., second-bead surface 320 is planar).

For the purpose of this disclosure, a given edge defined by one or more faces of head 108, or shared by two or more faces of head 108, is linear when it is arranged or extends in a straight, or nearly straight, line. As one example, third edge 120 is linear when an entire length of third edge 120, extending from first linear edge 112 to second linear edge 116, is arranged or extends in a straight, or nearly straight, line.

For the purpose of this disclosure, a given face of head 108 of sealant-applicator tip 100 is planar when it is two-dimensional in quality and lies on, or forms, a flat geometric plane. As one example, third face is planar when an entirety of third face 118, bound by third edge 120, seventh edge 130, eighth edge 136, and ninth edge 138, is two-dimensional in quality and lies on, or forms, a flat geometric plane For the purpose of this disclosure, a bead surface of a bead of sealant material 300 is planar when it is two-dimensional in quality and lies on, or forms, a flat geometric plane. As one example, second-bead surface 320 of second bead 314 of sealant material 300 is planar when an entirety of second-bead surface 320, extending between first planar surface 308 and second planar surface 310, defining corner joint 302, is two-dimensional in quality and lies on, or forms, a flat geometric plane.

For the purpose of this disclosure, any two given faces of head 108 of sealant-applicator tip 100 are oblique when they are neither parallel nor at a right angle to one another.

In one example, fourth edge 124 of fourth face 122 of sealant-applicator tip 100 is linear and lies in virtual flat plane 132. Fourth face 122, bound by fourth edge 124, fifth edge 126, and sixth edge 128, is planar. Fourth face 122 is oblique to third face 118. Fourth face 122 is perpendicular to first planar face 110 and second planar face 114.

Referring generally to FIG. 1 and particularly to, e.g., FIGS. 3, 6, 8, 15, 17A, and 17B, third edge 120 of third face 118 is non-linear. At least portion of third face 118, bounded by third edge 120, is convex. The preceding subject matter of this paragraph characterizes example 3 of the present disclosure, wherein example 3 also includes the subject matter according to example 1, above.

When sealant-applicator tip 100 is moved in second direction 318, opposite first direction 316, along corner joint 302, third edge 120 at least partially shapes sealant material 300, supplied to corner joint 302, to form second-bead surface 320 of second bead 314 of sealant material 300 (FIGS. 17A, 17B). A non-linear third edge 120 provides for, or forms, a concave second-bead surface 320 (i.e., second-bead surface 320 is concave).

For the purpose of this disclosure, a given edge defined by one or more faces of head 108, or shared by two or more faces of head 108, is non-linear when at least a portion of it is not arranged in a straight line, for example, having a curve or arcuate portion. As one example, third edge 120 is non-linear when an entire length of third edge 120, extending from first linear edge 112 to second linear edge 116, is not arranged in a straight line. As one example, third edge 120 is non-linear when a portion of the length of third edge 120, disposed between first linear edge 112 and second linear edge 116, is not arranged in a straight line.

For the purpose of this disclosure, a given face of head 108 is convex when at least a portion of it is three-dimensional in quality and is curved or rounded outwardly. As one example, third face 118 is convex when an entirety of third face 118, bound by third edge 120, eighth edge 136, and ninth edge 138, is three-dimensional in quality and is curved or rounded outwardly. As one example, third face 119 is convex when a portion of third face 118, at least partially bound by at least two of third edge 120, seventh edge 130, eighth edge 136, and ninth edge 138, is three-dimensional in quality and is curved or rounded outwardly.

For the purpose of this disclosure, a bead surface of a given bead of sealant material 300 is concave when at least a portion of it is three-dimensional in quality and is curved or rounded inwardly. As one example, second-bead surface 320 of second bead 314 of sealant material 300 is concave when an entirety of second-bead surface 320, extending between first planar surface 308 and second planar surface 310, defining corner joint 302, is three-dimensional in quality and is curved or rounded inwardly. As one example, second-bead surface 320 of second bead 314 of sealant material 300 is concave when at least a portion second-bead surface 320, disposed between first planar surface 308 and second planar surface 310, defining corner joint 302, is three-dimensional in quality and is curved or rounded inwardly.

Referring generally to FIG. 1 and particularly to, e.g., FIGS. 3, 6, 8 and 15, 17A, and 17B, third edge 120 of third face 118 is non-linear and at least portion of third face 118, bounded by third edge 120, is concave. The preceding subject matter of this paragraph characterizes example 4 of the present disclosure, wherein example 4 also includes the subject matter according to example 1, above.

When sealant-applicator tip 100 is moved in second direction 318, opposite first direction 316, along corner joint 302, third edge 120 of third face 118 of head 108 of sealant-applicator tip 100 at least partially shapes sealant material 300, supplied to corner joint 302, to form second-bead surface 320 of second bead 314 of sealant material 300 (FIGS. 17A, 17B). A non-linear third edge 120 forms a convex second-bead surface 320 (i.e., second-bead surface 320 is convex).

For the purpose of this disclosure, a given face of head 108 concave when at least a portion of it is three-dimensional in quality and is curved or rounded inwardly. As one example, third face 118 is concave when an entirety of third face 118, bound by third edge 120, eighth edge 136, and ninth edge 138, is three-dimensional in quality and is curved or rounded inwardly. As one example, third face 118 is concave when a portion of third face 118, at least partially bound by at least two of third edge 120, seventh edge 130, eighth edge 136, and ninth edge 138, is three-dimensional in quality and is curved or rounded inwardly.

For the purpose of this disclosure, a bead surface of a given bead of sealant material 300 is convex when at least a portion of it is three-dimensional in quality and is curved or rounded outwardly. As one example, second-bead surface 320 of second bead 314 of sealant material 300 is convex when an entirety of second-bead surface 320, extending between first planar surface 308 and second planar surface 310, defining corner joint 302, is three-dimensional in quality and is curved or rounded outwardly. As one example, second-bead surface 320 of second bead 314 of sealant material 300 is convex when at least a portion of second-bead surface 320, disposed between first planar surface 308 and second planar surface 310, defining corner joint 302, is three-dimensional in quality and is curved or rounded outwardly.

Referring generally to FIG. 1 and particularly to, e.g., FIGS. 3, 4, 6-8, 11, and 14-16B, seventh edge 130 of head 108 is linear. The preceding subject matter of this paragraph characterizes example 5 of the present disclosure, wherein example 5 also includes the subject matter according to any one of examples 1 to 4, above.

When sealant-applicator tip 100 is moved in first direction 316 along corner joint 302, seventh edge 130 at least partially shapes sealant material 300, supplied to corner joint 302, to form first-bead surface 324 of first bead 312 of sealant material 300 (FIGS. 16A, 16B).

As one example, first-bead surface 324 of first bead 312 of sealant material 300, extending between first planar surface 308 and second planar surface 310, defining corner joint 302, is planar. A linear seventh edge 130 provides for, or forms, a planar first-bead surface 334 (i.e., first-bead surface is planar).

Referring generally to FIG. 1 and particularly to, e.g., FIGS. 3, 4, 6-8, 11, and 14-16B, seventh edge 130 of head 108 is non-linear and at least portion of third face 118, bounded by seventh edge 130, is convex. The preceding subject matter of this paragraph characterizes example 6 of the present disclosure, wherein example 6 also includes the subject matter according to any one of examples 1 to 4, above.

When sealant-applicator tip 100 is moved in first direction 316 along corner joint 302, seventh edge 130 at least partially shapes sealant material 300, supplied to corner joint 302, to form first-bead surface 324 of first bead 312 of sealant material 300 (FIGS. 16A, 16B). A non-linear seventh edge 130 provides for, or forms, a concave first-bead surface 334 (i.e., first-bead surface 334 is concave).

As one example, an entire length of seventh edge 130, extending from fifth edge 126 to sixth edge 128, is non-linear. As one example, at least a portion of the length of seventh edge 130, disposed between fifth edge 126 and sixth edge 128, is non-linear.

As one example, an entirety of third face 118, bound by third edge 120, eighth edge 136, and ninth edge 138, is convex. As one example, at least a portion of third face 118, at least partially bound by at least two of third edge 120, seventh edge 130, eighth edge 136, and ninth edge 138, is convex.

As one example, an entirety of first-bead surface 324 of first bead 312 of sealant material 300, extending between first planar surface 308 and second planar surface 310, defining corner joint 302, is concave. As one example, at least a portion first-bead surface 324, disposed between first planar surface 308 and second planar surface 310, defining corner joint 302, is concave.

Referring generally to FIG. 1 and particularly to, e.g., FIGS. 3, 4, 6-8, 11, and 14-16B, seventh edge 130 of head 108 is non-linear and at least portion of third face 118, bounded by seventh edge 130, is concave. The preceding subject matter of this paragraph characterizes example 7 of the present disclosure, wherein example 7 also includes the subject matter according to any one of examples 1 to 4, above.

When sealant-applicator tip 100 is moved in first direction 316 along corner joint 302, seventh edge 130 at least partially shapes sealant material 300, supplied to corner joint 302, to form first-bead surface 324 of first bead 312 of sealant material 300 (FIGS. 16A, 16B). A non-linear seventh edge 130 provides for, or forms, a convex first-bead surface 334 (i.e., first-bead surface 334 is convex).

As one example, an entire length of seventh edge 130, extending from fifth edge 126 to sixth edge 128, is non-linear. As one example, at least a portion of the length of seventh edge 130, disposed between fifth edge 126 and sixth edge 128, is non-linear.

As one example, an entirety of third face 118, bound by third edge 120, eighth edge 136, and ninth edge 138, is convex. As one example, at least a portion of third face 118, at least partially bound by at least two of third edge 120, seventh edge 130, eighth edge 136, and ninth edge 138, is convex.

As one example, an entirety of first-bead surface 324 of first bead 312 of sealant material 300, extending between first planar surface 308 and second planar surface 310, defining corner joint 302, is convex. As one example, at least a portion of first-bead surface 324, disposed between first planar surface 308 and second planar surface 310, defining corner joint 302, is convex.

Referring generally to FIG. 1 and particularly to, e.g., FIGS. 6, 7, 13-16A, and 17A, virtual flat plane 132, containing first linear edge 112 of first planar face 110 and second linear edge 116 of second planar face 114, is perpendicular to plane of symmetry 104 of body 102. The preceding subject matter of this paragraph characterizes example 8 of the present disclosure, wherein example 8 also includes the subject matter according to any one of examples 1 to 7, above.

When sealant-applicator tip 100 is positioned relative to corner joint 302, with first planar face 110 of sealant-applicator tip 100 in flush surface contact with and parallel to one of first planar surface 308 or second planar surface 310 and with second planar face 114 of sealant-applicator tip 100 in flush contact with and parallel to another one of first planar surface 308 or second planar surface 310, virtual flat plane 132, being perpendicular to plane of symmetry 104 of body 102, positions body 102 at a perpendicular angle relative to first planar surface 308 and second planar surface 310, defining corner joint 302.

Referring generally to FIG. 1 and particularly to, e.g., FIGS. 6, 7, 13-16A, and 17A, virtual flat plane 132, containing first linear edge 112 of first planar face 110 and second linear edge 116 of second planar face 114, is oblique to plane of symmetry 104 of body 102. The preceding subject matter of this paragraph characterizes example 9 of the present disclosure, wherein example 9 also includes the subject matter according to any one of examples 1 to 7, above.

When sealant-applicator tip 100 is positioned relative to corner joint 302, with first planar face 110 of sealant-applicator tip 100 in flush surface contact with and parallel to one of first planar surface 308 or second planar surface 310 and with second planar face 114 of sealant-applicator tip 100 in flush contact with and parallel to another one of first planar surface 308 or second planar surface 310, virtual flat plane 132, being oblique to plane of symmetry 104 of body 102, positions body 102 at an oblique angle relative to first planar surface 308 and second planar surface 310, defining corner joint 302.

Figure 11:
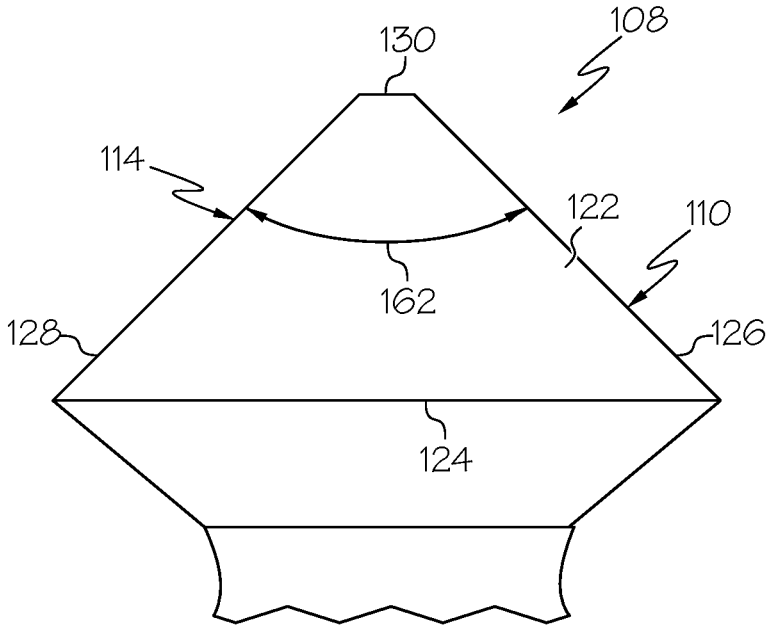

Referring generally to FIG. 1 and particularly to, e.g., FIGS. 11, 14, and 15, first non-zero angle 162 between first planar face 110 and second planar face 114 is a right angle. The preceding subject matter of this paragraph characterizes example 10 of the present disclosure, wherein example 10 also includes the subject matter according to any one of examples 1 to 9, above.

First non-zero angle 162, being a right angle, enables first planar face 110 to be in flush surface contact with and parallel to one of first planar surface 308 or second planar surface 310 and second planar face 114 to be in flush contact with and parallel to another one of first planar surface 308 or second planar surface 310 during application of sealant material 300 to corner joint 302 formed by first planar surface 308 and second planar surface 310 that are disposed at a right angle relative to each other.

Referring generally to FIG. 1 and particularly to, e.g., FIGS. 11, 14, and 15, first non-zero angle 162 between first planar face 110 and second planar face 114 is an acute angle. The preceding subject matter of this paragraph characterizes example 11 of the present disclosure, wherein example 11 also includes the subject matter according to any one of examples 1 to 9, above.

First non-zero angle 162, being an acute angle, enables first planar face 110 of sealant-applicator tip 100 to be in flush surface contact with and parallel to one of first planar surface 308 or second planar surface 310 and second planar face 114 of sealant-applicator tip 100 to be in flush contact with and parallel to another one of first planar surface 308 or second planar surface 310 during application of sealant material 300 to corner joint 302, formed by first planar surface 308 and second planar surface 310 that are disposed at an acute angle relative to each other.

Referring generally to FIG. 1 and particularly to, e.g., FIGS. 11, 14, and 15, first non-zero angle 162 between first planar face 110 and second planar face 114 is an obtuse angle. The preceding subject matter of this paragraph characterizes example 12 of the present disclosure, wherein example 12 also includes the subject matter according to any one of examples 1 to 9, above.

First non-zero angle 162, being an obtuse angle, enables first planar face 110 of sealant-applicator tip 100 to be in flush surface contact with and parallel to one of first planar surface 308 or second planar surface 310 and second planar face 114 of sealant-applicator tip 100 to be in flush contact with and parallel to another one of first planar surface 308 or second planar surface 310 during application of sealant material 300 to corner joint 302 formed by first planar surface 308 and second planar surface 310 that are disposed at an obtuse angle relative to each other.

Referring generally to FIG. 1 and particularly to, e.g., FIGS. 3, 4, 6, 8, and 15, head 108 further comprises eighth edge 136, shared between first planar face 110 and third face 118. The preceding subject matter of this paragraph characterizes example 13 of the present disclosure, wherein example 13 also includes the subject matter according to any one of examples 1 to 12, above.

When sealant-applicator tip 100 is positioned relative to corner joint 302, eighth edge 136 partially defines a boundary of sealant material 300 supplied to corner joint 302. When sealant-applicator tip 100 is advanced along corner joint 302, eighth edge 136 directs a supply of sealant material 300.

In one example, when sealant-applicator tip 100 is positioned relative to corner joint 302 and as sealant material 300 is being supplied to corner joint 302, eighth edge 136 defines one boundary of sealant material 300, third face 118 defines another boundary of sealant material 300, first planar surface 308 defines another boundary of sealant material 300, and second planar surface 310 defines yet another boundary of sealant material 300. When sealant material 300 is supplied to corner joint 302, third face 118 forces sealant material 300 fully into corner joint 302. When sealant-applicator tip 100 is advanced in first direction 316 along corner joint 302, eighth edge 136 partially directs a first supply of sealant material 300 toward seventh edge 130 to form first bead 312 of sealant material 300. When sealant-applicator tip 100 is advanced in second direction 318 along corner joint 302, eighth edge 136 partially directs a second supply of sealant material 300 toward third edge 120 to form second bead 314 of sealant material 300.

Referring generally to FIG. 1 and particularly to, e.g., FIGS. 3, 4, 6, 8, and 15, eighth edge 136 of head 108 is linear. The preceding subject matter of this paragraph characterizes example 14 of the present disclosure, wherein example 14 also includes the subject matter according to example 13, above.

When sealant-applicator tip 100 is positioned relative to corner joint 302, a linear eighth edge 136 defines a linear portion of the boundary of sealant material 300 supplied to corner joint 302. When sealant-applicator tip 100 is advanced along corner joint 302, the linear eighth edge 136 directs a supply of sealant material 300 along a linear path.

In one example, when sealant-applicator tip 100 is positioned relative to corner joint 302 and as sealant material 300 is being supplied to corner joint 302, the linear eighth edge 136 defines a linear boundary of sealant material 300, a planar third face 118 defines a planar boundary of sealant material 300, first planar surface 308 defines another planar boundary of sealant material 300, and second planar surface 310 defines yet another planar boundary of sealant material 300. When sealant material 300 is supplied to corner joint 302, the planar third face 118 forces a supplied amount of sealant material 300 fully into corner joint 302. When sealant-applicator tip 100 is advanced in first direction 316 along corner joint 302, the linear eighth edge 136 partially directs a first supply of sealant material 300 toward seventh edge 130 along a linear path to form first bead 312 of sealant material 300. When sealant-applicator tip 100 is advanced in second direction 318 along corner joint 302, the linear eighth edge 136 partially directs a second supply of sealant material 300 toward third edge 120 along a linear path to form second bead 314 of sealant material 300.

Referring generally to FIG. 1 and particularly to, e.g., FIGS. 3, 4, 6, 8, and 15, eighth edge 136 of head 108 is non-linear and at least portion of third face 118 of head 108, bounded by eighth edge 136, is convex. The preceding subject matter of this paragraph characterizes example 15 of the present disclosure, wherein example 15 also includes the subject matter according to example 13, above.

When sealant-applicator tip 100 is positioned relative to corner joint 302, a non-linear eighth edge 136 defines a non-linear portion of the boundary of sealant material 300 supplied to corner joint 302. When sealant-applicator tip 100 is positioned relative to corner joint 302, a convex third face 118 defines a convex portion of the boundary of sealant material 300. When sealant-applicator tip 100 is advanced along corner joint 302, the non-linear eighth edge 136 directs a supply of sealant material 300 along a non-linear path.

In one example, when sealant-applicator tip 100 is positioned relative to corner joint 302, the non-linear eighth edge 136 defines a non-linear boundary of sealant material 300 supplied to corner joint 302, the convex third face 118 defines a convex boundary of sealant material 300 supplied to corner joint 302, first planar surface 308 defines a planar boundary of sealant material 300 supplied to corner joint 302, and second planar surface 310 defines another planar boundary of sealant material 300 supplied to corner joint 302. When sealant material 300 is supplied to corner joint 302, the convex third face 118 forces a supplied amount of sealant material 300 fully into corner joint 302. When sealant-applicator tip 100 is advanced in first direction 316 along corner joint 302, the non-linear eighth edge 136 partially directs a first supply of sealant material 300 toward seventh edge 130 along a non-linear path to form first bead 312 of sealant material 300. When sealant-applicator tip 100 is advanced in second direction 318 along corner joint 302, the non-linear eighth edge 136 partially directs a second supply of sealant material 300 toward third edge 120 along a non-linear path to form second bead 314 of sealant material 300.

Referring generally to FIG. 1 and particularly to, e.g., FIGS. 3, 4, 6, 8, and 15, eighth edge 136 of head 108 is non-linear and at least portion of third face 118, bounded by eighth edge 136, is concave. The preceding subject matter of this paragraph characterizes example 16 of the present disclosure, wherein example 16 also includes the subject matter according to example 13, above.

When sealant-applicator tip 100 is positioned relative to corner joint 302, a non-linear eighth edge 136 defines a non-linear portion of the boundary of sealant material 300 supplied to corner joint 302. When sealant-applicator tip 100 is positioned relative to corner joint 302, a concave third face 118 defines a concave portion of the boundary of sealant material 300. When sealant-applicator tip 100 is advanced along corner joint 302, the non-linear eighth edge 136 directs a supply of sealant material 300 along a non-linear path In one example, when sealant-applicator tip 100 is positioned relative to corner joint 302, the non-linear eighth edge 136 defines a non-linear boundary of sealant material 300 supplied to corner joint 302, the concave third face 118 defines a concave boundary of sealant material 300 supplied to corner joint 302, first planar surface 308 defines a planar boundary of sealant material 300 supplied to corner joint 302, and second planar surface 310 defines another planar boundary of sealant material 300 supplied to corner joint 302. When sealant material 300 is supplied to corner joint 302, the concave third face 118 forces a supplied amount of sealant material 300 fully into corner joint 302. When sealant-applicator tip 100 is advanced in first direction 316 along corner joint 302, the non-linear eighth edge 136 partially directs a first supply of sealant material 300 toward seventh edge 130 along a non-linear path to form first bead 312 of sealant material 300. When sealant-applicator tip 100 is advanced in second direction 318 along corner joint 302, the non-linear eighth edge 136 partially directs a second supply of sealant material 300 toward third edge 120 along a non-linear path to form second bead 314 of sealant material 300.

Referring generally to FIG. 1 and particularly to, e.g., FIGS. 3, 4, 6, 8, and 15, head 108 further comprises ninth edge 138, shared between second planar face 114 and third face 118. The preceding subject matter of this paragraph characterizes example 17 of the present disclosure, wherein example 17 also includes the subject matter according to any one of examples 1 to 16, above.

When sealant-applicator tip 100 is positioned relative to corner joint 302, ninth edge 138 partially defines a boundary of sealant material 300 supplied to corner joint 302. When sealant-applicator tip 100 is advanced along corner joint 302, ninth edge 138 directs a supply of sealant material 300.

In one example, when sealant-applicator tip 100 is positioned relative to corner joint 302 and as sealant material 300 is being supplied to corner joint 302, ninth edge 138 defines one boundary of sealant material 300, third face 118 defines another boundary of sealant material 300, first planar surface 308 defines another boundary of sealant material 300, and second planar surface 310 defines yet another boundary of sealant material 300. When sealant material 300 is supplied to corner joint 302, third face 118 forces sealant material 300 fully into corner joint 302. When sealant-applicator tip 100 is advanced in first direction 316 along corner joint 302, ninth edge 138 partially directs a first supply of sealant material 300 toward seventh edge 130 to form first bead 312 of sealant material 300. When sealant-applicator tip 100 is advanced in second direction 318 along corner joint 302, ninth edge 138 partially directs a second supply of sealant material 300 toward third edge 120 to form second bead 314 of sealant material 300.

In one example, when sealant-applicator tip 100 is positioned relative to corner joint 302 and as sealant material 300 is being supplied to corner joint 302, eighth edge 136 defines one boundary of sealant material 300, ninth edge 138 defines another boundary of sealant material 300, third face 118 defines another boundary of sealant material 300, first planar surface 308 defines another boundary of sealant material 300, and second planar surface 310 defines yet another boundary of sealant material 300. When sealant-applicator tip 100 is advanced in first direction 316 along corner joint 302, eighth edge 136 and ninth edge 138 direct a first supply of sealant material 300 toward seventh edge 130 to form first bead 312 of sealant material 300. When sealant-applicator tip 100 is advanced in second direction 318 along corner joint 302, eighth edge 136 and ninth edge 138 direct a second supply of sealant material 300 toward third edge 120 to form second bead 314 of sealant material 300.

Referring generally to FIG. 1 and particularly to, e.g., FIGS. 3, 4, 6, 8, and 15, ninth edge 138 of head 108 is linear. The preceding subject matter of this paragraph characterizes example 18 of the present disclosure, wherein example 18 also includes the subject matter according to example 17, above.

When sealant-applicator tip 100 is positioned relative to corner joint 302, a linear ninth edge 138 defines a linear portion of the boundary of sealant material 300 supplied to corner joint 302. When sealant-applicator tip 100 is advanced along corner joint 302, the linear ninth edge 138 directs a supply of sealant material 300 along a linear path.

In one example, when sealant-applicator tip 100 is positioned relative to corner joint 302 and as sealant material 300 is being supplied to corner joint 302, the linear ninth edge 138 defines a linear boundary of sealant material 300, a planar third face 118 defines a planar boundary of sealant material 300, first planar surface 308 defines another planar boundary of sealant material 300, and second planar surface 310 defines yet another planar boundary of sealant material 300. When sealant material 300 is supplied to corner joint 302, the planar third face 118 forces a supplied amount of sealant material 300 fully into corner joint 302. When sealant-applicator tip 100 is advanced in first direction 316 along corner joint 302, the linear ninth edge 138 partially directs a first supply of sealant material 300 toward seventh edge 130 along a linear path to form first bead 312 of sealant material 300. When sealant-applicator tip 100 is advanced in second direction 318 along corner joint 302, the linear ninth edge 138 partially directs a second supply of sealant material 300 toward third edge 120 along a linear path to form second bead 314 of sealant material 300.

In one example, when sealant-applicator tip 100 is positioned relative to corner joint 302 and as sealant material 300 is being supplied to corner joint 302, the linear eighth edge 136 defines one linear boundary of sealant material 300, the linear ninth edge 138 defines another linear boundary of sealant material 300, the planar third face 118 defines a planar boundary of sealant material 300, first planar surface 308 defines another planar boundary of sealant material 300, and second planar surface 310 defines yet another planar boundary of sealant material 300. When sealant-applicator tip 100 is advanced in first direction 316 along corner joint 302, the linear eighth edge 136, the linear ninth edge 138, and the planar third face 118 direct a first supply of sealant material 300 toward seventh edge 130 along a linear path to form first bead 312 of sealant material 300. When sealant-applicator tip 100 is advanced in second direction 318 along corner joint 302, the linear eighth edge 136, the linear ninth edge 138, and the planar third face 118 direct a second supply of sealant material 300 toward third edge 120 along a linear path to form second bead 314 of sealant material 300.

Referring generally to FIG. 1 and particularly to, e.g., FIGS. 3, 4, 6, 8, and 15, ninth edge 138 of head 108 is non-linear and at least portion of third face 118, bounded by ninth edge 138, is convex. The preceding subject matter of this paragraph characterizes example 19 of the present disclosure, wherein example 19 also includes the subject matter according to example 17, above.

When sealant-applicator tip 100 is positioned relative to corner joint 302, a non-linear ninth edge 138 defines a non-linear portion of the boundary of sealant material 300 supplied to corner joint 302. When sealant-applicator tip 100 is positioned relative to corner joint 302, a convex third face 118 defines a convex portion of the boundary of sealant material 300. When sealant-applicator tip 100 is advanced along corner joint 302, the non-linear ninth edge 138 directs a supply of sealant material 300 along a non-linear path.

In one example, when sealant-applicator tip 100 is positioned relative to corner joint 302 and as sealant material 300 is being supplied to corner joint 302, the non-linear ninth edge 138 defines a non-linear boundary of sealant material 300, the convex third face 118 defines a convex boundary of sealant material 300, first planar surface 308 defines a planar boundary of sealant material 300, and second planar surface 310 defines another planar boundary of sealant material 300. When sealant material 300 is supplied to corner joint 302, the convex third face 118 forces a supplied amount of sealant material 300 fully into corner joint 302. When sealant-applicator tip 100 is advanced in first direction 316 along corner joint 302, the non-linear ninth edge 138 partially directs a first supply of sealant material 300 toward seventh edge 130 along a non-linear path to form first bead 312 of sealant material 300. When sealant-applicator tip 100 is advanced in second direction 318 along corner joint 302, the non-linear ninth edge 138 partially directs a second supply of sealant material 300 toward third edge 120 along a non-linear path to form second bead 314 of sealant material 300.

In one example, when sealant-applicator tip 100 is positioned relative to corner joint 302 and as sealant material 300 is being supplied to corner joint 302, the non-linear eighth edge 136 defines a non-linear boundary of sealant material 300, the non-linear ninth edge 138 defines another non-linear boundary of sealant material 300, the convex third face 118 defines a convex boundary of sealant material 300, first planar surface 308 defines a planar boundary of sealant material 300, and second planar surface 310 defines yet another planar boundary of sealant material 300. When sealant-applicator tip 100 is advanced in first direction 316 along corner joint 302, the non-linear eighth edge 136, the non-linear ninth edge 138, and the convex third face 118 direct a first supply of sealant material 300 toward seventh edge 130 along a non-linear path to form first bead 312 of sealant material 300. When sealant-applicator tip 100 is advanced in second direction 318 along corner joint 302, the non-linear eighth edge 136, the non-linear ninth edge 138, and the convex third face 118 direct a second supply of sealant material 300 toward third edge 120 along a non-linear path to form second bead 314 of sealant material 300.

Referring generally to FIG. 1 and particularly to, e.g., FIGS. 3, 4, 6, 8, and 15, ninth edge 138 of head 108 is curved and at least portion of third face 118, bounded by ninth edge 138, is concave. The preceding subject matter of this paragraph characterizes example 20 of the present disclosure, wherein example 20 also includes the subject matter according to example 17, above.

When sealant-applicator tip 100 is positioned relative to corner joint 302, a non-linear ninth edge 138 defines a non-linear portion of the boundary of sealant material 300 supplied to corner joint 302. When sealant-applicator tip 100 is positioned relative to corner joint 302, a concave third face 118 defines a concave portion of the boundary of sealant material 300. When sealant-applicator tip 100 is advanced along corner joint 302, the non-linear ninth edge 138 directs a supply of sealant material 300 along a non-linear path.

In one example, when sealant-applicator tip 100 is positioned relative to corner joint 302 and as sealant material 300 is being supplied to corner joint 302, the non-linear ninth edge 138 defines a non-linear boundary of sealant material 300, the concave third face 118 defines a concave boundary of sealant material 300, first planar surface 308 defines a planar boundary of sealant material 300, and second planar surface 310 defines another planar boundary of sealant material 300. When sealant material 300 is supplied to corner joint 302, the concave third face 118 forces a supplied amount of sealant material 300 fully into corner joint 302. When sealant-applicator tip 100 is advanced in first direction 316 along corner joint 302, the non-linear ninth edge 138 partially directs a first supply of sealant material 300 toward seventh edge 130 along a non-linear path to form first bead 312 of sealant material 300. When sealant-applicator tip 100 is advanced in second direction 318 along corner joint 302, the non-linear ninth edge 138 partially directs a second supply of sealant material 300 toward third edge 120 along a non-linear path to form second bead 314 of sealant material 300.

In one example, when sealant-applicator tip 100 is positioned relative to corner joint 302 and as sealant material 300 is being supplied to corner joint 302, the non-linear eighth edge 136 defines a non-linear boundary of sealant material 300, the non-linear ninth edge 138 defines another non-linear boundary of sealant material 300, the concave third face 118 defines a concave boundary of sealant material 300, first planar surface 308 defines a planar boundary of sealant material 300, and second planar surface 310 defines yet another planar boundary of sealant material 300. When sealant-applicator tip 100 is advanced in first direction 316 along corner joint 302, the non-linear eighth edge 136, the non-linear ninth edge 138, and the concave third face 118 direct a first supply of sealant material 300 toward seventh edge 130 along a non-linear path to form first bead 312 of sealant material 300. When sealant-applicator tip 100 is advanced in second direction 318 along corner joint 302, the non-linear eighth edge 136, the non-linear ninth edge 138, and the concave third face 118 direct a second supply of sealant material 300 toward third edge 120 along a non-linear path to form second bead 314 of sealant material 300.

Referring generally to FIG. 1 and particularly to, e.g., FIGS. 2, 3, 6, 8, and 15-17B, outlet opening 134 of head 108 has perimeter edge 178 and axis of symmetry 176. Perimeter edge 178 comprises linear segment 180, adjacent to third edge 120 of third face 118. Perimeter edge 178 also comprises first curved segment 182, extending from linear segment 180 toward seventh edge 130 of head 108. Perimeter edge further comprises second curved segment 184, extending from linear segment 180 to first curved segment 182. Axis of symmetry 176 bisects linear segment 180. First curved segment 182 and second curved segment 184 are symmetric about axis of symmetry 176. The preceding subject matter of this paragraph characterizes example 21 of the present disclosure, wherein example 21 also includes the subject matter according to any one of examples 1 to 20, above.

When sealant-applicator tip 100 is advanced in one (e.g., either one) of first direction 316 or second direction 318, outlet opening 134 is controls a flow of sealant material 300 supplied to corner joint 302.

In one example, when sealant-applicator tip 100 is advanced in first direction 316, the flow of sealant material 300, or an amount of sealant material 300 supplied to corner joint 302, is least (e.g., smallest) proximate to a convergence of first curved segment 182 and second curved segment 184, for example, proximate to seventh edge 130, to form first bead 312 of sealant material 300, which is then shaped by seventh edge 130. The flow of sealant material 300, or an amount of sealant material 300 supplied to corner joint 302, gradually increases from proximate the convergence of first curved segment 182 and second curved segment 184, along first curved segment 182 and second curved segment 184, to proximate linear segment 180. When sealant-applicator tip 100 is advanced in second direction 318, the flow of sealant material 300, or an amount of sealant material 300 supplied to corner joint 302, is greatest (e.g., largest) proximate to linear segment 180 (e.g., proximate to third edge 120, to form second bead 314 of sealant material 300, covering first bead 312 of sealant material 300, which is then shaped by third edge 120.

Referring generally to FIG. 1 and particularly to, e.g., FIGS. 2, 3, 6, 8, and 15, axis of symmetry 176 of outlet opening 134 bisects third face 118 in two equal halves. The preceding subject matter of this paragraph characterizes example 22 of the present disclosure, wherein example 22 also includes the subject matter according to example 21, above.

Bisecting third face 118 in two equal halves by axis of symmetry 176 centers outlet opening 134 upon third face 118 and supplies an equal amount of sealant material 300 to both sides of corner joint 302 formed by first planar surface 308 and second planar surface 310.

Referring generally to FIG. 1 and particularly to, e.g., FIGS. 2, 3, 6, 8, and 15, third face 118 comprises a truncated triangular shape. The preceding subject matter of this paragraph characterizes example 23 of the present disclosure, wherein example 23 also includes the subject matter according to any one of examples 21 to 22, above.

The truncated triangular shape of third face 118 permits third face 118 to fit within corner joint 302 between first planar surface 308 and second planar surface 310 and spaces third edge 120 and seventh edge 130 away from an intersection of first planar surface 308 and second planar surface 310.

In one example, when sealant-applicator tip 100 is positioned relative to and engages corner joint 302, the truncated triangular shape of third face 118 spaces seventh edge 130 away from the intersection of first planar surface 308 and second planar surface 310. When sealant-applicator tip 100 is advanced in first direction 316, seventh edge 130 shapes first bead 312 of sealant material 300. When sealant-applicator tip 100 is positioned relative to and engages corner joint 302, the truncated triangular shape of third face 118 spaces third edge 120 away from the intersection of first planar surface 308 and second planar surface 310. When sealant-applicator tip 100 is advanced in second direction 318, third edge 120 shapes second bead 314 of sealant material 300.

Figure 10:
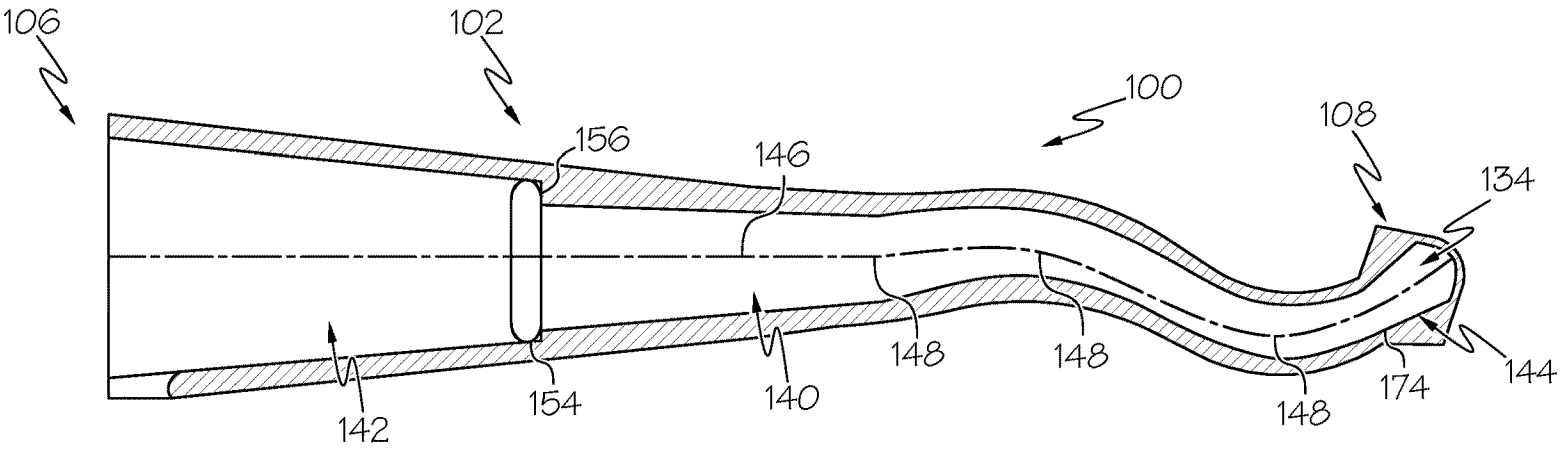

Referring generally to FIG. 1 and particularly to, e.g., FIG. 10, body 102 defines channel-body portion 142 of channel 140. Head 108 defines channel-head portion 144 of channel 140. Channel-head portion 144 is in communication with channel-body portion 142. The preceding subject matter of this paragraph characterizes example 24 of the present disclosure, wherein example 24 also includes the subject matter according to any one of examples 1 to 23, above.

Channel 140 provides for the delivery of sealant material 300 from sealant delivery-nozzle 326 to corner joint 302.

In one example, channel 140 provides for the flow of sealant material 300 from sealant-delivery nozzle 326, into inlet opening 106, through body 102 and head 108, and out from outlet opening 134 for delivery into corner joint 302.

Referring generally to FIG. 1 and particularly to, e.g., FIG. 10, channel 140 further comprises channel interface 174, connecting channel-body portion 142 and channel-head portion 144. At least a portion of channel-body portion 142 tapers inwardly from inlet opening 106 of body 102 to channel interface 174. At least a portion of channel-head portion 144 tapers outwardly from channel interface 174 to outlet opening 134 of head 108. The preceding subject matter of this paragraph characterizes example 25 of the present disclosure, wherein example 25 also includes the subject matter according to example 24, above.

A combination of channel-body portion 142 tapering inwardly, from inlet opening 106 to channel interface 174, and channel-head portion 144 tapering outwardly, from channel interface 174 to outlet opening 134, reduces the flow of sealant material 300 along channel 140 and controls back pressure within channel 140.

Figure 9:
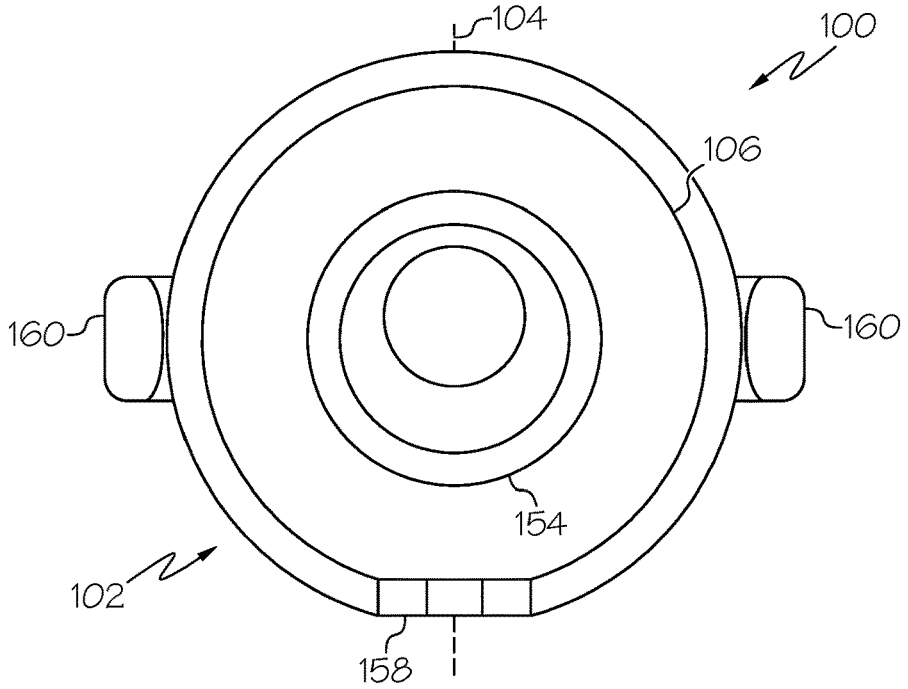

Referring generally to FIG. 1 and particularly to, e.g., FIGS. 9 and 10, sealant-applicator tip 100 also comprises O-ring 154, located in channel-body portion 142 of channel 140. The preceding subject matter of this paragraph characterizes example 26 of the present disclosure, wherein example 26 also includes the subject matter according to any one of examples 24 to 25, above.

O-ring 154 provides a seal at a contact interface between an end of sealant-delivery nozzle 326 and sealant-applicator tip 100.

As an example, O-ring 154 forms a mechanical gasket between the end of sealant-delivery nozzle 326 and an interior of sealant-applicator tip 100 defining channel 140.

Referring generally to FIG. 1 and particularly to, e.g., FIGS. 9 and 10, body 102 further comprises an internal annular shoulder 156, formed in channel-body portion 142 of channel 140. O-ring 154 is received by internal annular shoulder 156. The preceding subject matter of this paragraph characterizes example 27 of the present disclosure, wherein example 27 also includes the subject matter according to example 26, above.

Annular shoulder 156 provides a limiting interface for insertion of sealant-delivery nozzle 326 through inlet opening 106 and into channel-body portion 142 of channel 140 and positions O-ring 154 between annular should 156 and the end of sealant-delivery nozzle 326.

As an example, annular shoulder 156 seats O-ring 154 and forms a sealing interface between the end of sealant-delivery nozzle 326 and an interior of sealant-applicator tip 100, defining channel 140.

Referring generally to FIG. 1 and particularly to, e.g., FIGS. 2-4 and 8, first planar face 110 has triangular shape. The preceding subject matter of this paragraph characterizes example 28 of the present disclosure, wherein example 28 also includes the subject matter according to any one of examples 1 to 27, above.

First planar face 110 having triangular shape permits first planar face 110 to engage one of first planar surface 308 or second planar surface 310 and provides for third edge 120 to be longer than seventh edge 130.

Referring generally to FIG. 1 and particularly to, e.g., FIGS. 2-4 and 8, second planar face 114 has triangular shape. The preceding subject matter of this paragraph characterizes example 29 of the present disclosure, wherein example 29 also includes the subject matter according to any one of examples 1 to 28, above.

Second planar face 114 having triangular shape permits first planar face 110 to engage another one of first planar surface 308 or second planar surface 310 and provides for third edge 120 to be longer than seventh edge 130.

Referring generally to FIG. 1 and particularly to, e.g., FIGS. 10 and 13, body 102 comprises medial axis 146, comprising at least one inflection point 148. The preceding subject matter of this paragraph characterizes example 30 of the present disclosure, wherein example 30 also includes the subject matter according to any one of examples 1 to 29, above.

When sealant-applicator tip 100 is positioned relative to corner joint 302, medial axis 146 of body 102 having at least one inflection point 148 permits head 108 of sealant-applicator tip 100 to engage corner joint 302, with first planar face 110 in flush surface contact with and parallel to one of first planar surface 308 or second planar surface 310 and with second planar face 114 in flush contact with and parallel to another one of first planar surface 308 or second planar surface 310. When sealant-applicator tip 100 is advanced in at least one of (e.g., either one or both of) first direction 316 and/or second direction 318, medial axis 146 of body 102 having at least one inflection point 148 permits body 102 to avoid one or more obstructions 328 located proximate to (e.g., at or near) corner joint 302.

For the purpose of this disclosure, a medial axis of a three-dimensional surface is a set of all points, not on the three-dimensional surface, each of which has more than one closest point on the three-dimensional surface. The medial axis of an object is the set of all points having more than one closest point on the object's boundary.

For purposes of this disclosure, an inflection point is defined as a transition point between two straight portions of a line or segment, a concave portion and a convex portion of a line or segment, a concave portion and a straight portion of a line or segment, or a convex portion and a straight portion of a line or segment, as viewed from one side of the line or segment.

The number of inflection points 148 of medial axis 146 of body 102 and/or an angle disposed between the two portions of the line or segment of medial axis 146 may vary depending upon a configuration of corner joint 302 and/or the size and/or locations of any obstructions 328 proximate to corner joint 302.

Figure 5:
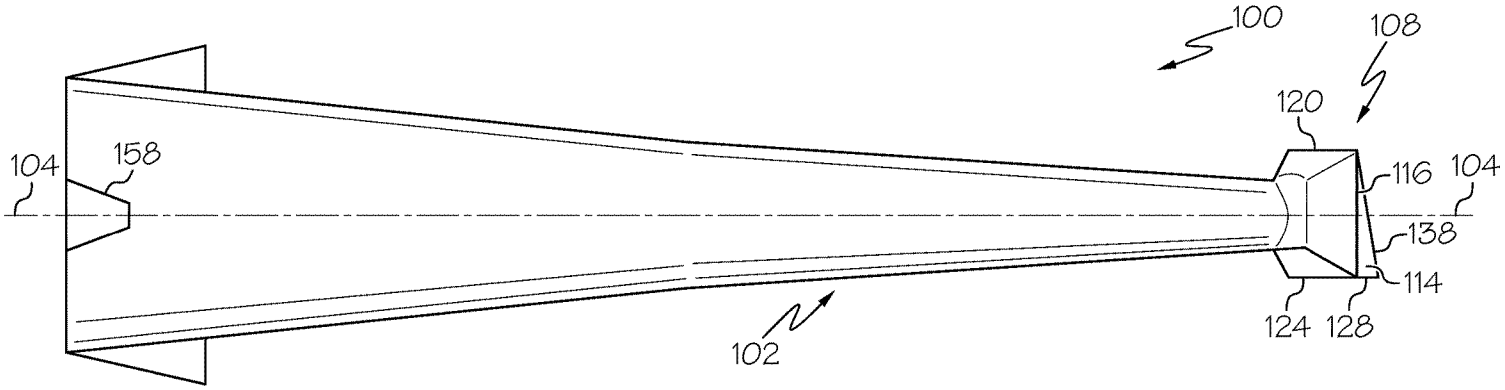
Figure 6:
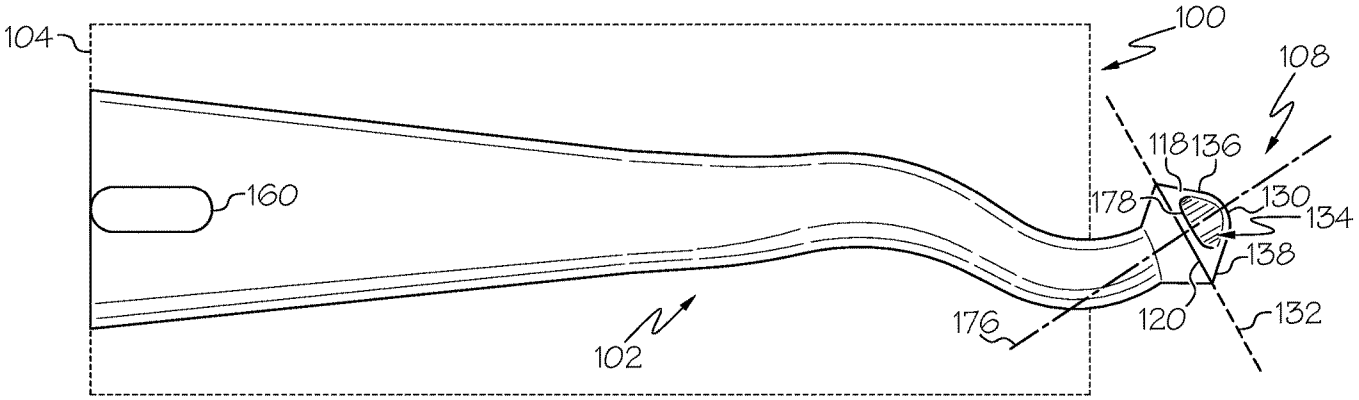
Figure 7:
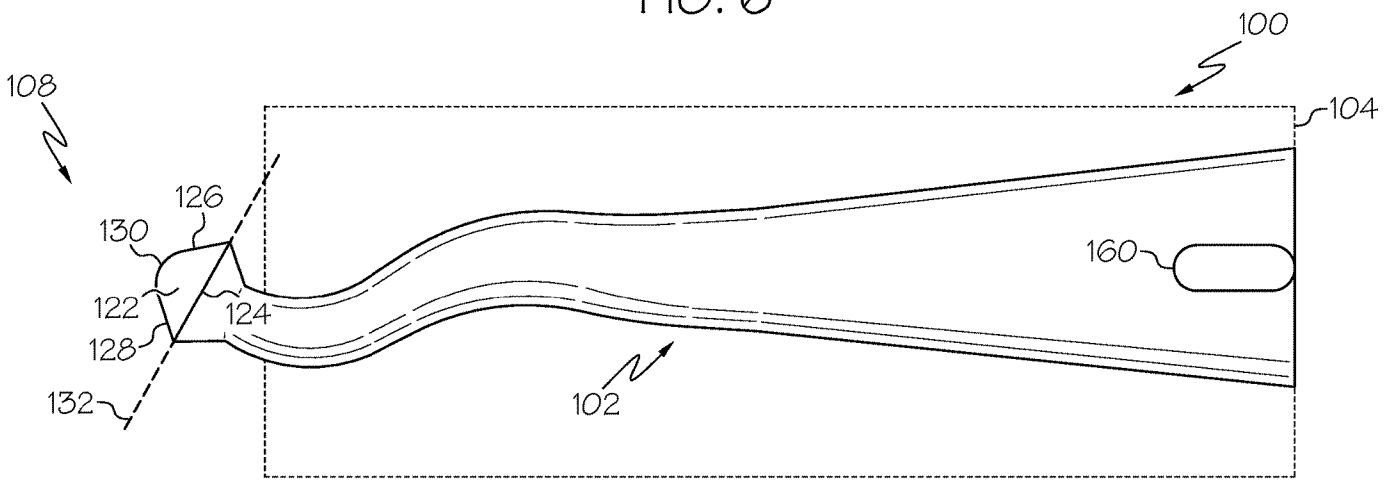
Figure 8:
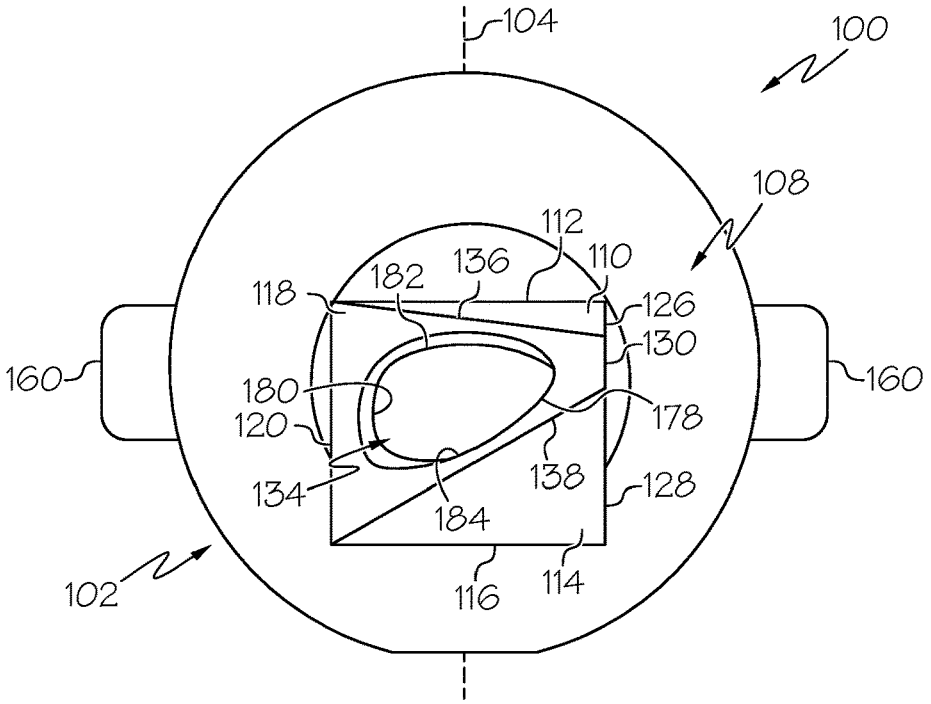

Referring generally to FIG. 1 and particularly to, e.g., FIGS. 5 and 9, sealant-applicator tip 100 also comprises notch 158, extending along portion of body 102 from inlet opening 106. The preceding subject matter of this paragraph characterizes example 31 of the present disclosure, wherein example 31 also includes the subject matter according to any one of examples 1 to 30, above.

Notch 158 provides for connection of sealant-applicator tip 100 to sealant-delivery nozzle 326.

As one example, when the end of sealant-delivery nozzle 326 is inserted through inlet opening 106 and into channel 140, notch 158 is configured to receive a protrusion (not illustrated) extending from sealant-delivery nozzle 326 to couple sealant-delivery nozzle 326 and sealant-applicator tip 100 together.

Referring generally to FIG. 1 and particularly to, e.g., FIGS. 4-9, sealant-applicator tip 100 also comprises opposed pair of teeth 160, extending outwardly from body 102 proximate inlet opening 106. The preceding subject matter of this paragraph characterizes example 32 of the present disclosure, wherein example 32 also includes the subject matter according to any one of examples 1 to 31, above.

Opposed pair of teeth 160 provide for connection of sealant-applicator tip 100 to sealant-delivery nozzle 326.

As one example, when the end of sealant-delivery nozzle 326 is inserted through inlet opening 106 and into channel 140, opposed pair of teeth 160 are configured to engage a corresponding pair of recesses (not illustrated) formed in sealant-delivery nozzle 326 to couple sealant-delivery nozzle 326 and sealant-applicator tip 100 together.

Referring generally to FIG. 1 and particularly to, e.g., FIGS. 5, 7, 11, and 14, fourth edge 124 of fourth face 122 of head 108 is linear. The preceding subject matter of this paragraph characterizes example 33 of the present disclosure, wherein example 33 also includes the subject matter according to any one of examples 1 to 32, above.

Fourth edge 124 being linear positions fourth edge 124 in virtual flat plane 132.

Referring generally to FIG. 1 and particularly to, e.g., FIGS. 3, 4, 7, 8, 13, and 14, fifth edge 126 of head 108 is linear. The preceding subject matter of this paragraph characterizes example 34 of the present disclosure, wherein example 34 also includes the subject matter according to any one of examples 1 to 33, above.

Fifth edge 126 being linear positions fifth edge 126 oblique to virtual flat plane 132.

In one example, fifth edge 126 is non-linear

Referring generally to FIG. 1 and particularly to, e.g., FIGS. 3, 4, 7, 8, 13, and 14, sixth edge 128 of head 108 is linear. The preceding subject matter of this paragraph characterizes example 35 of the present disclosure, wherein example 35 also includes the subject matter according to any one of examples 1 to 34, above.

Sixth edge 128 being linear positions sixth edge 128 oblique to virtual flat plane 132.

In one example, sixth edge 128 is non-linear

Referring generally to, e.g., FIGS. 2-9 and 13-17B and particularly to FIG. 12, method 500 of applying sealant material 300 to corner joint 302, formed by first planar surface 308 and second planar surface 310, is disclosed. Method 500 comprises (block 502) positioning sealant-applicator tip 100 relative to corner joint 302 such that first planar face 110 of sealant-applicator tip 100 is in flush surface contact with and parallel to one of first planar surface 308 or second planar surface 310 and second planar face 114 of sealant-applicator tip 100 is in flush contact with and parallel to another one of first planar surface 308 or second planar surface 310. Method 500 also comprises (block 504) advancing sealant-applicator tip 100 in first direction 316 along corner joint 302 while supplying sealant material 300 to corner joint 302 through channel 140 of sealant-applicator tip 100 and shaping sealant material 300, supplied to corner joint 302, with seventh edge 130 of sealant-applicator tip 100 to form first bead 312 of sealant material 300. The preceding subject matter of this paragraph characterizes example 36 of the present disclosure.

Sealant material 300 may accordingly be accurately applied to corner joint 302 to form first bead 312 resulting from one continuous linear movement of sealant-applicator tip 100 along corner joint 302 in first direction 316.

Use of sealant-applicator tip 100 allows for sealant material 300 to be applied to corner joint 302, formed by first planar surface 308 and second planar surface 310, in order to form first bead 312. First bead 312 includes first-bead surface 324. Maintaining sealant-applicator tip 100 in position relative to and engaged with corner joint 302 and advancing sealant-applicator tip 100 along corner joint 302, in one continuous linear movement in first direction 316, forms first bead 312 (e.g., shapes first-bead surface 324). Sealant material 300 is supplied through channel 140 of sealant-applicator tip 100 and applied to corner joint 302. When sealant-applicator tip 100 is advanced along corner joint 302 in first direction 316, sealant material 300 is simultaneously applied to corner joint 302 and immediately shaped by seventh edge 130 to form first bead 312 (e.g., first-bead surface 324).

Referring generally to, e.g., FIGS. 2-9 and 13-17B and particularly to FIG. 12, method 500 also comprises (block 506) advancing sealant-applicator tip 100 in second direction 318 along corner joint 302, opposite first direction 316, while supplying sealant material 300 to corner joint 302 through channel 140 of sealant-applicator tip 100 and shaping sealant material 300, supplied to corner joint 302, with third edge 120 of sealant-applicator tip 100 to form second bead 314 of sealant material 300, covering first bead 312 of sealant material 300. The preceding subject matter of this paragraph characterizes example 37 of the present disclosure, wherein example 37 also includes the subject matter according to example 36, above.

Following formation of first bead 312, sealant material 300 may accordingly be accurately applied to corner joint 302 to form second bead 314, covering first bead 312, resulting from one continuous linear movement of sealant-applicator tip 100 along corner joint 302 in second direction 318, opposite first direction 316, without removing or disengaging sealant-applicator tip 100 from corner joint 302.

Use of sealant-applicator tip 100 allows for sealant material 300 to be applied to corner joint 302, formed by first planar surface 308 and second planar surface 310, in order to form second bead 314, covering directly over top of first bead 312. Second bead 314 includes second-bead surface 320 extending between first planar surface 308 and second planar surface 310 and completely covering first-bead surface 324. Maintaining sealant-applicator tip 100 in position relative to and engaged with corner joint 302 and advancing sealant-applicator tip 100 along corner joint 302, in one continuous linear movement in second direction 318, opposite first direction 316, forms second bead 314 (e.g., shapes second-bead surface 320). Sealant material 300 is supplied through channel 140 of sealant-applicator tip 100 and applied to corner joint 302. When sealant-applicator tip 100 is advanced along corner joint 302 in second direction 318, sealant material 300 is simultaneously applied to corner joint 302 and immediately shaped by third edge 120 to form second bead 314 (e.g., second-bead surface 320).

Referring generally to, e.g., FIGS. 2-9 and 13-17B and particularly to FIG. 12, according to method 500, (block 508) third edge 120 of sealant-applicator tip 100 is linear. Additionally, according to method 500, (block 510) shaping sealant material 300, supplied to corner joint 302, with third edge 120 of sealant-applicator tip 100 to form second bead 314 of sealant material 300, covering first bead 312 of sealant material 300, comprises forming second-bead surface 320 of second bead 314, extending from first planar surface 308 to second planar surface 310. Additionally, according to method 500, (block 512) second-bead surface 320 is planar. The preceding subject matter of this paragraph characterizes example 38 of the present disclosure, wherein example 38 also includes the subject matter according to example 37, above.

When sealant material 300 is supplied through channel 140 of sealant-applicator tip 100 and sealant-applicator tip 100 is advanced along corner joint 302 in second direction 318, sealant-applicator tip 100 allows sealant material 300 to be simultaneously applied to corner joint 302 and second-bead surface 320, covering first-bead surface 324, to be immediately formed by third edge 120. The linear third edge 120 forms the planar second-bead surface 320.

Referring generally to, e.g., FIGS. 2-9 and 13-17B and particularly to FIG. 12, according to method 500, (block 514) third edge 120 of sealant-applicator tip 100 is non-linear. Additionally, according to method 500, (block 510) shaping sealant material 300, supplied to corner joint 302, with third edge 120 of sealant-applicator tip 100 to form second bead 314 of sealant material 300, covering first bead 312 of sealant material 300, comprises forming second-bead surface 320 of second bead 314, extending from first planar surface 308 to second planar surface 310. Additionally, according to method 500, (block 516) second-bead surface 320 is convex. The preceding subject matter of this paragraph characterizes example 39 of the present disclosure, wherein example 39 also includes the subject matter according to example 37, above.

When sealant material 300 is applied through channel 140 of sealant-applicator tip 100 and sealant-applicator tip 100 is advanced along corner joint 302 in second direction 318, sealant-applicator tip 100 allows sealant material 300 to be simultaneously applied to corner joint 302 and second-bead surface 320, covering first-bead surface 324, to be immediately formed by third edge 120. The non-linear third edge 120 forms the convex second-bead surface 320.

Referring generally to, e.g., FIGS. 2-9 and 13-17B and particularly to FIG. 12, according to method 500, (block 514) third edge 120 of sealant-applicator tip 100 is non-linear. Additionally, according to method 500, (block 510) shaping sealant material 300, supplied to corner joint 302, with third edge 120 of sealant-applicator tip 100 to form second bead 314 of sealant material 300, covering first bead 312 of sealant material 300, comprises forming second-bead surface 320 of second bead 314, extending from first planar surface 308 to second planar surface 310. Additionally, according to method 500, (block 516) second-bead surface 320 is concave. The preceding subject matter of this paragraph characterizes example 40 of the present disclosure, wherein example 40 also includes the subject matter according to example 37, above.

When sealant material 300 is applied through channel 140 of sealant-applicator tip 100 and sealant-applicator tip 100 is advanced along corner joint 302 in second direction 318, sealant-applicator tip 100 allows sealant material 300 to be simultaneously applied to corner joint 302 and second-bead surface 320, covering first-bead surface 324, to be immediately formed by third edge 120. The non-linear third edge 120 forms the concave second-bead surface 320.

Examples of the present disclosure may be described in the context of aircraft manufacturing and service method 1100 as shown in FIG. 18 and aircraft 1102 as shown in FIG. 19. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 19, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing (block 1108) may be fabricated or manufactured in a manner similar to components or subassemblies produced while aircraft 1102 is in service (block 1114). Also, one or more examples of the apparatus (es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service (block 1114) and/or during maintenance and service (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A sealant-applicator tip, comprising:

a body, having a plane of symmetry, wherein the body comprises an inlet opening;

a head, extending from the body opposite the inlet opening, wherein the head comprises:

a first planar face, comprising a first linear edge;

a second planar face, comprising a second linear edge, wherein the first linear edge of the first planar face and the second linear edge of the second planar face lie in a virtual flat plane and are parallel to each other;

a third face, separating the first planar face from the second planar face, wherein the third face comprises a third edge, extending between the first linear edge and the second linear edge, and wherein each of the first planar face and the second planar face is oriented at an oblique angle to the third face;

a fourth face, comprising a fourth edge;

a fifth edge, shared by the first planar face and the fourth face;

a sixth edge, shared by the second planar face and the fourth face;

a seventh edge, shared by the third face and the fourth face, and an outlet opening, formed in the third face, wherein the outlet opening is in communication with the inlet opening of the body; and a channel, extending from the inlet opening to the outlet opening.

2. The sealant-applicator tip according to claim 1, wherein the third edge of the third face is linear and lies in the virtual flat plane, the third face is planar, and the third face is oblique to the first planar face and to the second planar face.

3. The sealant-applicator tip according to claim 1, wherein the virtual flat plane, containing the first linear edge of the first planar face and the second linear edge of the second planar face, is perpendicular to the plane of symmetry of the body.

4. The sealant-applicator tip according to claim 1, wherein the virtual flat plane, containing the first linear edge of the first planar face and the second linear edge of the second planar face, is oblique to the plane of symmetry of the body.

5. The sealant-applicator tip according to claim 1, wherein the head further comprises an eighth edge, shared between the first planar face and the third face.

6. The sealant-applicator tip according to claim 1, wherein the head further comprises a ninth edge, shared between the second planar face and the third face.

7. The sealant-applicator tip according to claim 1, wherein the outlet opening of the head has a perimeter edge and an axis of symmetry, and wherein the perimeter edge comprises:

a linear segment, adjacent to the third edge of the third face;

a first curved segment, extending from the linear segment toward the seventh edge of the head; and a second curved segment, extending from the linear segment to the first curved segment, and wherein:

the axis of symmetry bisects the linear segment, and the first curved segment and the second curved segment are symmetric about the axis of symmetry.

8. The sealant-applicator tip according to claim 7, wherein the axis of symmetry of the outlet opening bisects the third face in two equal halves.

9. The sealant-applicator tip according to claim 7, wherein the third face comprises a truncated triangular shape.

10. The sealant-applicator tip according to claim 1, wherein:

the body defines a channel-body portion of the channel, the head defines a channel-head portion of the channel, and the channel-head portion is in communication with the channel-body portion.

11. The sealant-applicator tip according to claim 10, wherein:

the channel further comprises a channel interface, connecting the channel-body portion and the channel-head portion, at least a portion of the channel-body portion tapers inwardly from the inlet opening of the body to the channel interface, and at least a portion of the channel-head portion tapers outwardly from the channel interface to the outlet opening of the head.

12. The sealant-applicator tip according to claim 10, further comprising an O-ring, located in the channel-body portion of the channel.

13. The sealant-applicator tip according to claim 12, wherein:

the body further comprises an internal annular shoulder formed in the channel-body portion of the channel, and the O-ring is received by the internal annular shoulder.

14. The sealant-applicator tip according to claim 1, wherein the first planar face has a triangular shape.

15. The sealant-applicator tip according to claim 1, wherein the second planar face has a triangular shape.

16. The sealant-applicator tip according to claim 1, wherein the body comprises a medial axis, comprising at least one inflection point.

17. The sealant-applicator tip according to claim 1, further comprising a notch, extending along a portion of the body from the inlet opening.

18. The sealant-applicator tip according to claim 1, further comprising an opposed pair of teeth, extending outwardly from the body proximate the inlet opening.

19. The sealant-applicator tip according to claim 1, wherein:

the seventh edge of the head is linear;

the third edge of the head is linear; and the seventh edge and the third edge are parallel to each other.

20. The sealant-applicator tip according to claim 1, wherein each of the first planar face and the second planar face is oriented at a forty-five degree angle to the third face.

* * * * *